US011492223B2

(12) United States Patent
Kawamata et al.

(10) Patent No.: US 11,492,223 B2
(45) Date of Patent: Nov. 8, 2022

(54) SHEET CONVEYING DEVICE AND IMAGE FORMING APPARATUS INCORPORATING THE SHEET CONVEYING DEVICE

(71) Applicants: Yuji Kawamata, Tokyo (JP); Kazuto Shibuya, Kanagawa (JP)

(72) Inventors: Yuji Kawamata, Tokyo (JP); Kazuto Shibuya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 372 days.

(21) Appl. No.: 16/738,036

(22) Filed: Jan. 9, 2020

(65) Prior Publication Data

US 2020/0231397 A1 Jul. 23, 2020

(30) Foreign Application Priority Data

Jan. 21, 2019 (JP) ..... JP2019-007675
Oct. 16, 2019 (JP) ..... JP2019-189124

(51) Int. Cl.
*B65H 9/00* (2006.01)

(52) U.S. Cl.
CPC ..... *B65H 9/006* (2013.01); *B65H 2404/144* (2013.01); *B65H 2404/1441* (2013.01); *B65H 2404/7231* (2013.01); *B65H 2601/11* (2013.01); *B65H 2801/15* (2013.01)

(58) Field of Classification Search
CPC ..... B65H 9/006; B65H 2601/11; B65H 2404/144; B65H 2404/14; B65H 2402/32
See application file for complete search history.

(56) References Cited

U.S. PATENT DOCUMENTS 5,307,116 A * 4/1994 Ikunami ..... G03G 21/1638 271/9.01
8,200,141 B2 * 6/2012 Matsushima ..... G03G 15/6579 399/361
9,272,865 B2 * 3/2016 Tsumura ..... B65H 5/38
9,678,465 B2 * 6/2017 Katsuyama ..... G03G 15/6502
9,878,862 B2 * 1/2018 Maruta ..... B65H 1/266
(Continued)

FOREIGN PATENT DOCUMENTS

JP 6-001471 1/1994
JP 2000-305392 11/2000
(Continued)

*Primary Examiner* — Patrick Cicchino
(74) *Attorney, Agent, or Firm* — Harness, Dickey & Pierce, P.L.C.

(57) ABSTRACT

A sheet conveying device includes a support configured to move between a storage position and a full open position and including a pair of rollers, a plurality of contact bodies, and a switching unit. The switching unit switches the pair of rollers in response to contact of the plurality of contact target bodies included in the switching unit, with the plurality of contact bodies. The plurality of contact bodies includes a first contact body closer to the storage position than the plurality of contact target bodies with the support at the full open position and closer to the full open position with the support at the storage position, and a second contact body closer to the storage position than a part of the plurality of contact target bodies with the support at a halfway position and closer to the full open position with the support at the storage position.

7 Claims, 14 Drawing Sheets

(56) References Cited

U.S. PATENT DOCUMENTS

| | | | | |
|---|---|---|---|---|
| 11,117,765 | B2 * | 9/2021 | Lee | B65H 5/38 |
| 2014/0183811 | A1 | 7/2014 | Takenaka | |

FOREIGN PATENT DOCUMENTS

| | | |
|---|---|---|
| JP | 2001-142269 | 5/2001 |
| JP | 2003-072977 | 3/2003 |
| JP | 2014-125332 | 7/2014 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2019-007675, filed on Jan. 21, 2019, and 2019-189124, filed on Oct. 16, 2019, in the Japan Patent Office, the entire disclosure of each of which is hereby incorporated by reference herein.

BACKGROUND

Technical Field

This disclosure relates to a sheet conveying device and an image forming apparatus incorporating the sheet conveying device.

Discussion of the Background Art

Various types of sheet conveying devices are known to include a support unit including a pair of rollers to grip a sheet to be conveyed. Such a support unit is movable between an installed position to a housing of the sheet conveying device and a full open position from the housing of the sheet conveying device.

SUMMARY

At least one aspect of this disclosure provides a sheet conveying device including a support configured to move between a storage position and a full open position, with respect to a housing of an image forming apparatus. The support includes a pair of rollers, a plurality of contact bodies, and a switching unit. The pair of rollers includes two rollers and configured to hold and convey a sheet. The plurality of contact bodies is provided in the housing of the image forming apparatus. The switching unit includes a plurality of contact target bodies disposed at different positions along a direction of movement of the support and is configured to contact the plurality of contact bodies during the movement of the support or at completion of the movement of the support from the full open position to the storage position. The switching unit is configured to switch the two rollers between a press contact state and a roller separated state. The switching unit is configured to switch the two rollers from the roller separated state to the press contact state in response to contact of the plurality of contact target bodies with the plurality of contact bodies. The plurality of contact bodies includes a first contact body and a second contact body. The first contact body is located at a position closer to the storage position than the plurality of contact target bodies in a case in which the support is located at the full open position and is located at a position closer to the full open position than the plurality of contact target bodies in a case in which the support is located at the storage position. The second contact body is located at a position closer to the storage position than a part of the plurality of contact target bodies located closer to the storage position than the first contact body in a case in which the support is located at a halfway position between the storage position and the full open position and is located at a position closer to the full open position than the plurality of contact target bodies in a case in which the support is located at the storage position.

Further, at least one aspect of this disclosure provides an image forming apparatus including the above-described sheet conveying device and a housing including an image forming unit configured to form an image on the sheet conveyed by the sheet conveying device.

BRIEF DESCRIPTION OF THE SEVERAL VIEWS OF THE DRAWINGS

An exemplary embodiment of this disclosure will be described in detail based on the following figured, wherein.

Figure 1:
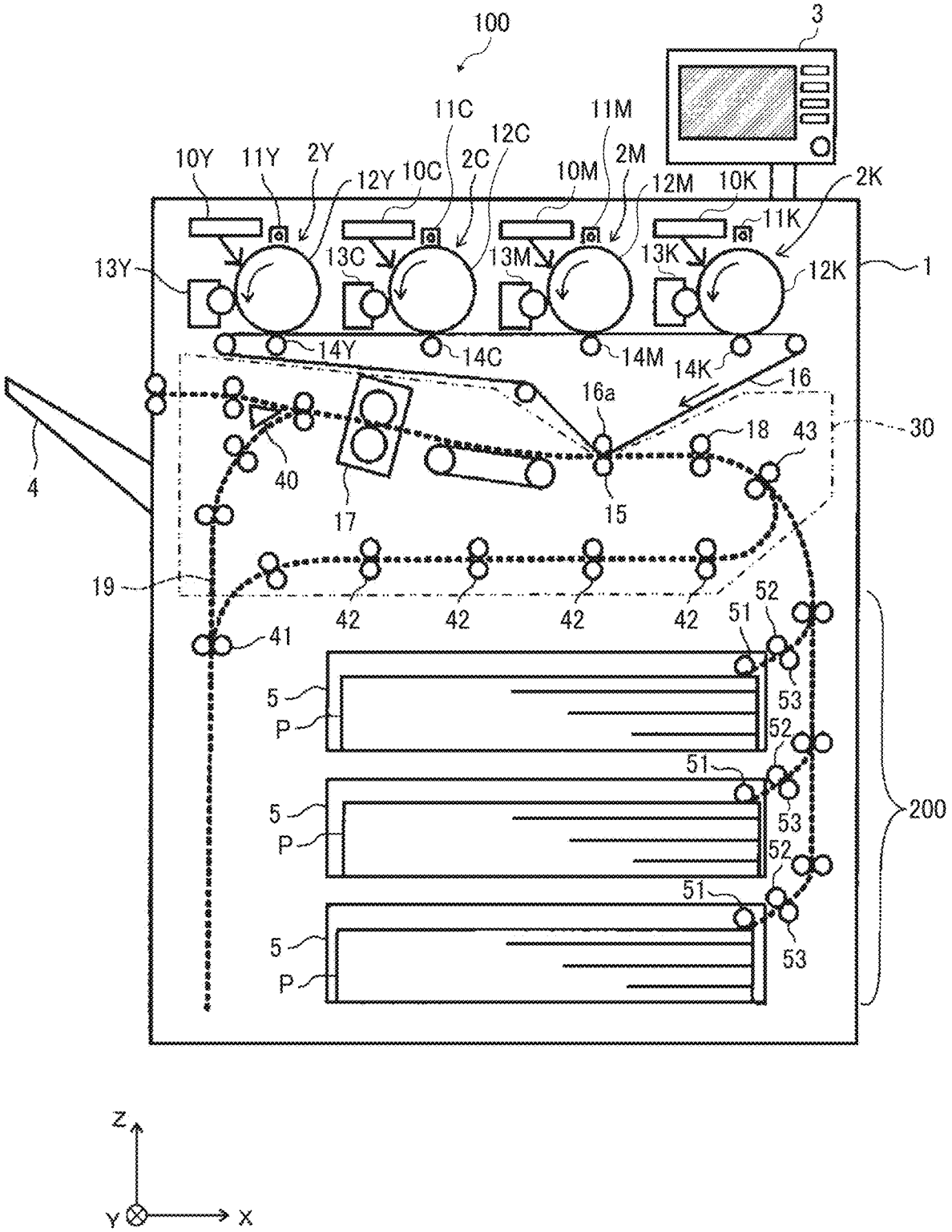
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet conveying device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet conveying device and image forming apparatus and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an electrophotographic image forming apparatus (hereinafter simply referred to as an image forming apparatus) which forms an image by an electrophotographic system is described as an image forming apparatus including a sheet conveying device according to this disclosure. In the following embodiments, a color laser printer is described as an example of the image forming apparatus. However, the image forming apparatus is not limited to a color printer but may be a monochrome printer. The image forming apparatus is not limited to the printer and may be another image forming apparatus such as a copier and a multifunction peripheral. The image forming apparatus including the sheet conveying device according to the present embodiment is not limited to the image forming apparatus of the electrophotographic system and may be an image forming apparatus of another system such as an ink jet system.

Now, a description is given of an electrophotographic image forming apparatus (hereinafter, simply referred to as an image forming apparatus) incorporating a sheet conveying device 300, for forming images by electrophotography.

In the present embodiment, the image forming apparatus includes a color laser printer, but the configuration is not limited to this configuration. For example, a monochrome image forming apparatus, a copier, and a multifunction peripheral may be applied to the image forming apparatus. Further, it is to be noted that the image forming apparatus provided with the sheet conveying device 300 according to an embodiment of this disclosure is not limited to an electrophotographic image forming apparatus. For example, the image forming apparatus according to an embodiment of this disclosure may be an inkjet image forming apparatus may employ a different method such as an inkjet method.

FIG. 1 is a diagram illustrating a schematic configuration of an image forming apparatus 100 according to an embodiment of this disclosure.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

It is to be noted that reference sign "X" indicates is a direction from the front side to the rear side of the image forming apparatus 100, reference sign "Y" indicates is a direction from the left side to the right side of the image forming apparatus 100, and reference sign "Z" indicates is a direction perpendicular to the direction X and the direction Y.

In FIG. 1, the image forming apparatus 100 includes a housing 1 including an intermediate transfer belt 16 and four image forming units 2Y, 2M, 2C, and 2K. The intermediate transfer belt 16 is provided in an intermediate transfer unit disposed at a substantially center of the housing 1 of the image forming apparatus 100. The image forming units 2Y, 2M, 2C, and 2K are disposed above the intermediate transfer belt 16. The image forming units 2Y, 2M, 2C, and 2K are aligned to form toner images with toners of yellow (Y), magenta (M), cyan (C), and black (K), respectively. The image forming units 2Y, 2M, 2C, and 2K have a substantially identical configuration and functions to each other. Therefore, following details of the image forming units 2Y, 2M, 2C, and 2K are described with a single image forming unit that corresponds to each of the image forming units 2Y, 2M, 2C, and 2K, without the suffixes Y, M, C and K indicating respective colors.

The image forming unit 2 includes a photoconductor 12 (i.e., photoconductors 12Y, 12M, 12C, and 12K) and image forming components disposed around the photoconductor 12. The photoconductor 12 functions as a latent image bearer disposed facing a tensioned face of an upper part of the intermediate transfer belt 16. The image forming components are a charging unit 11 that functions as a charger, a laser scanning unit 10 (i.e., laser scanning units 10Y, 10M, 10C, and 10K) that functions as a latent image forming unit, and a developing unit 13 (i.e., developing units 13Y, 13M, 13C, and 13K) that functions as a developing unit. The image forming apparatus 100 further includes a primary transfer roller 14 disposed facing the photoconductor 12 with the intermediate transfer belt 16 interposed between the primary transfer roller 14 and the photoconductor 12, which forms a primary transfer nip region.

A secondary transfer roller 15 is disposed below the intermediate transfer belt 16. A secondary transfer counter roller 16*a* is disposed facing the secondary transfer roller 15 with the intermediate transfer belt 16 interposed between the secondary transfer roller 15 and the secondary transfer counter roller 16*a*, which forms a secondary transfer nip region.

A sheet feeding device 200 is disposed below the housing 1 of the image forming apparatus 100. The sheet feeding device 200 includes three sheet feed trays 5 in steps, which are a first sheet feed tray 5, a second sheet feed tray 5, and a third sheet feed tray 5. Each of the sheet feed trays 5 contains a sheet P that functions as a recording medium such as a transfer sheet and a resin film.

As the image forming apparatus 100 starts a print job, the photoconductor 12 is driven and rotated in a counterclockwise direction in FIG. 1. Consequently, the intermediate transfer belt 16 is driven and rotated in a clockwise direction in FIG. 1. At this time, the charging unit 11 uniformly charges a surface of the photoconductor 12 to a predetermined polarity. Then, the laser scanning unit 10 (i.e., the laser scanning units 10Y, 10M, 10C, and 10K of respective colors) emits laser light based on image data, onto the surface of the charged surface of the photoconductor 12, thereby forming an electrostatic latent image on the surface of the photoconductor 12. Then, the developing unit 13 develops the electrostatic latent image formed on the surface of the photoconductor 12 into a visible toner image. The toner image is transferred onto the intermediate transfer belt 16 by the primary transfer roller 14 in the primary transfer nip region.

It is to be noted that residual toner remains on the surface of the photoconductor 12 after the primary transfer of the toner image onto the intermediate transfer belt 16. Such residual toner is removed by a photoconductor cleaning unit provided in the image forming unit 2.

When forming a color image, the above-described image forming operation is performed in all the image forming units 2Y, 2C, 2M, and 2K, so that a yellow toner image, a cyan toner image, a magenta toner image, and a black toner image formed on respective photoconductors 12Y, 12C, 12M, and 12K are sequentially transferred to the intermediate transfer belt 16 in a superimposed manner.

The sheet P is fed from the sheet feeding device 200. A user selects one of the three sheet feed trays 5 via an input terminal such as a control panel 3 or an external personal computer, so as to feed the sheet P contained in the selected sheet feed tray 5.

As illustrated in FIG. 1, each of the three sheet feed trays 5 of the sheet feeding device 200 includes a sheet feeding unit including a sheet feed roller 51, a sheet separation and conveyance roller 52, and a reverse roller 53. The sheet feeding unit feeds the sheet P contained in the selected sheet feed tray 5. Specifically, the sheet P conveyed by the sheet feed roller 51 is conveyed into a separation nip region that is a contact position where the sheet separation and conveyance roller 52 and the reverse roller 53 contact. The sheet separation and conveyance roller 52 rotationally drives in the counterclockwise direction in FIG. 1 as a drive motor transmits a conveyance force toward a downstream side in a sheet conveyance direction to the sheet P.

A sheet conveyance passage 19 is indicated by a broken line in FIG. 1. The sheet P travels along the sheet conveyance passage 19 in the image forming apparatus 100.

The sheet P that is fed from the selected sheet feed tray 5 is conveyed toward a pair of registration rollers 18 and a leading end of the sheet P contacts the pair of registration rollers 18 while the pair of registration rollers 18 is stopped with rollers of the pair of registration rollers 18 contacting each other in a pressed state. After the sheet P has contacted and aligned by the pair of registration rollers 18 (in other words, after skew of the sheet P has been corrected by the pair of registration rollers 18), the pair of registration rollers 18 conveys the sheet P toward the secondary transfer nip region at a timing synchronized with a timing of conveyance of the toner image on the intermediate transfer belt 16. The transfer residual toner remains on and adheres to a surface of the intermediate transfer belt 16 after the secondary transfer of the toner image at the secondary transfer nip region. Such transfer residual toner is removed by an intermediate transfer belt cleaning device.

The sheet P onto which an unfixed toner image is transferred at the secondary transfer nip region is then conveyed to a fixing device 17. In the fixing device 17, the unfixed toner image is fixed to the sheet P, then ejected to a sheet ejection tray 4 in a case of single-side printing. In a case of duplex printing, a branching claw 40 switches and changes an orientation of the sheet P, so that the sheet P having an image on a first face is conveyed to a duplex printing passage. The sheet P conveyed to a pair of reverse rollers 41 by the branching claw 40 is then conveyed to a pair of duplex printing rollers 42 by forward rotations and reverse rotations of the pair of reverse rollers 41. At this time, both the front and back sides of the sheet P with respect to a sheet conveyance direction are reversed from the state in which the image is formed on the front face of the sheet P. After the sheet P is conveyed to a pair of relay rollers 43 and the pair of registration rollers 18, an image is also formed on a second face by a process similar to the above-described image formation process, and the sheet P having the images on both sides (i.e., the first face and the second face) of the sheet P is ejected to the sheet ejection tray 4.

Now, a description is given of a configuration and functions of a drawer unit 30 according to the present embodiment of this disclosure.

Figure 2:
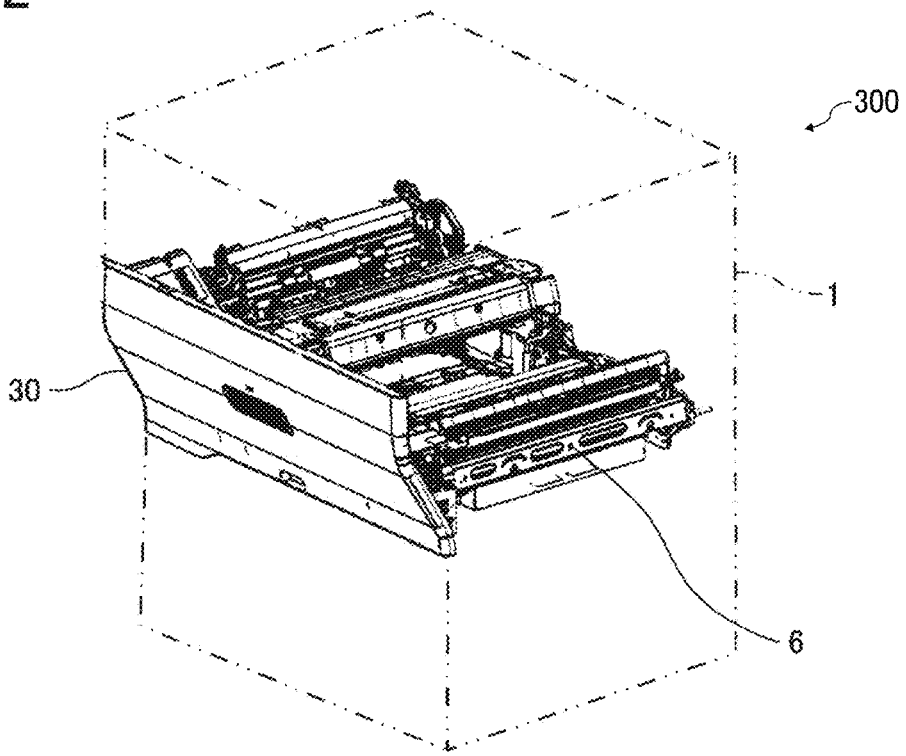
FIG. 2 is a perspective view illustrating a drawer unit of the image forming apparatus in a state in which the drawer unit is located at a drawer storage position inside a housing of the image forming apparatus.
Figure 3:
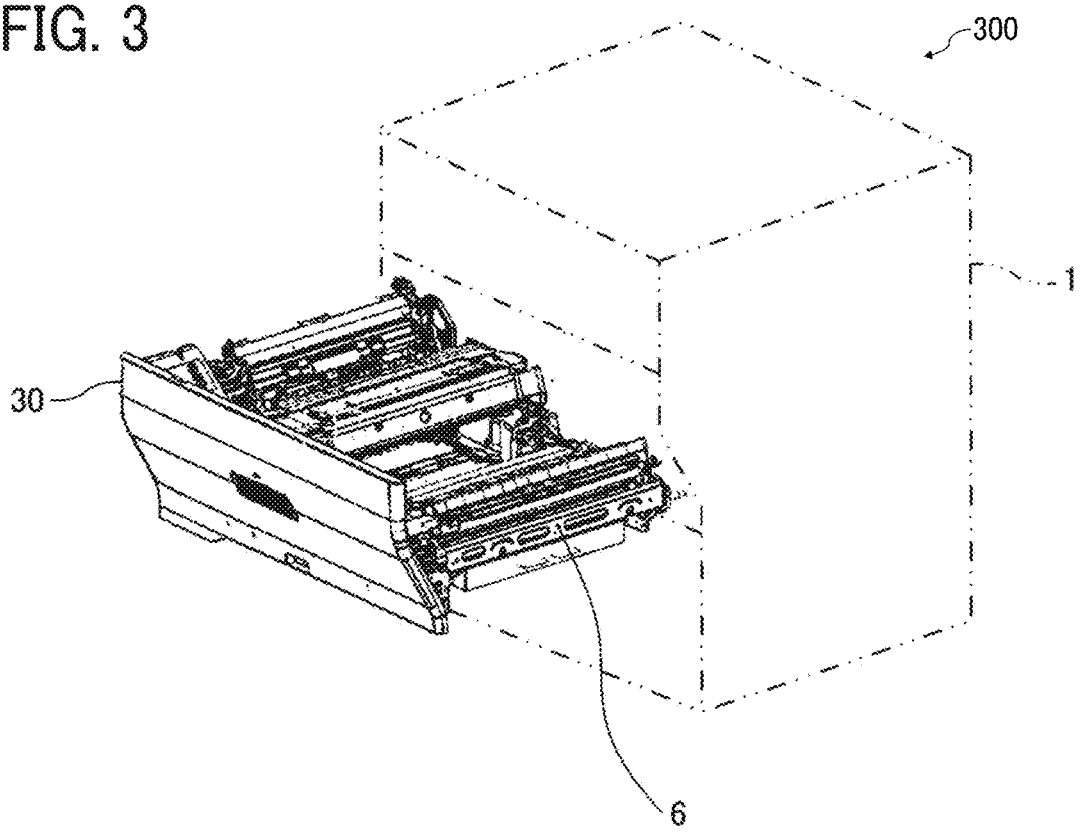
FIG. 3 is a perspective view illustrating the drawer unit in a state in which the drawer unit is pulled out to a pull-out position outside the housing of the image forming apparatus.

FIG. 2 is a perspective view illustrating the drawer unit 30 of the image forming apparatus 100 in a state in which the drawer unit 30 is located at a drawer storage position inside a housing 1 of the image forming apparatus 100. FIG. 3 is a perspective view illustrating the drawer unit 30 in a state in which the drawer unit 30 is pulled out to a pull-out position that functions as a non-storage position located outside the housing 1 of the image forming apparatus 100.

In the present embodiment, the drawer unit 30 is provided to be slidable with respect to the housing 1 of the image forming apparatus 100, along a direction from the front side to the rear side of the image forming apparatus 100, by a slide rail 6 that functions as a holder. When a paper jam occurs in the image forming apparatus 100, in an area near the pair of registration rollers 18, a user pulls out the drawer unit 30, in which the pair of registration rollers 18 is provided, from the drawer storage position in the housing 1 illustrated in FIG. 2 toward the front side of the image forming apparatus 100. After the drawer unit 30 has been pulled out to the pull-out position (i.e., a full open position) illustrated in FIG. 3, the user performs a paper jam handling. At the pull-out position, the user releases the press contact state of the pair of registration rollers 18 to switch to a non-press contact state, so that the user performs a paper jam handling with respect to the sheet P held by the pair of registration rollers 18. After completion of the paper jam handling, the user switches the pair of registration rollers 18 to the press contact state again, and then presses the drawer unit 30 to the drawer storage position illustrated in FIG. 2. As a result of the above-described operation, the pair of registration rollers 18 in the press contact state performs skew correction (correction of displacement of the sheet P) and conveyance of the sheet P.

Figure 4:
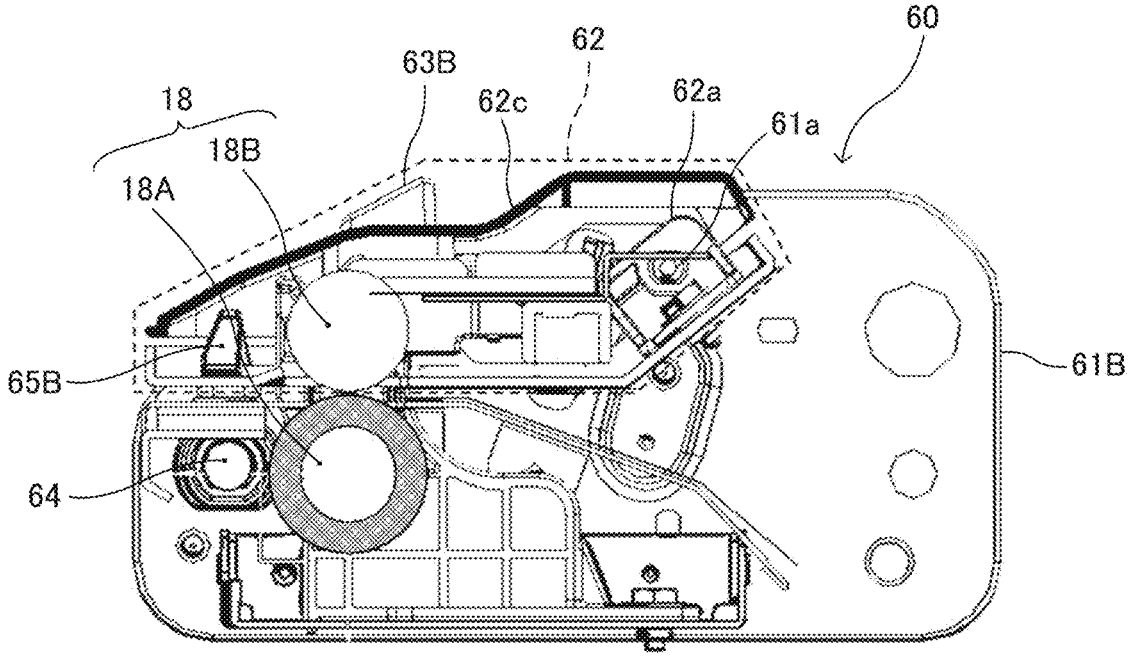
FIG. 4 is a cross sectional view illustrating a registration roller unit in a locked state, disposed on the drawer unit and cut in a direction perpendicular to an axial direction of the registration roller unit.
Figure 5:
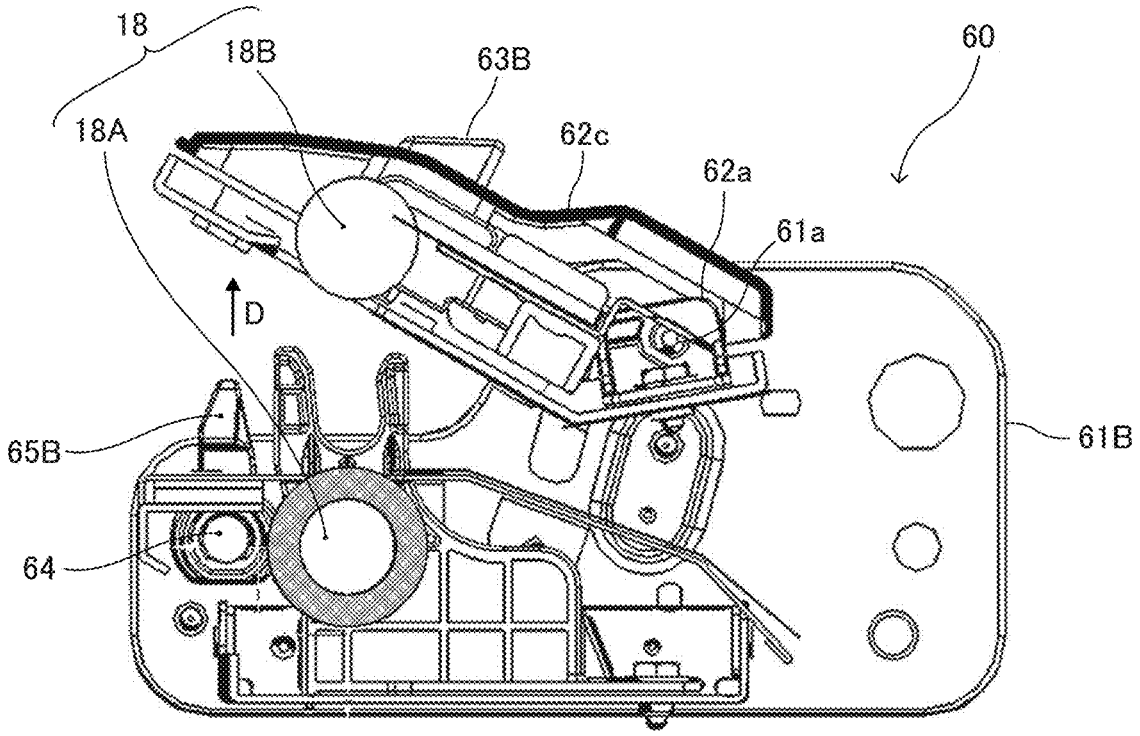
FIG. 5 is a cross sectional view illustrating the registration roller unit in a non-lock state, disposed on the drawer unit and cut in the direction perpendicular to the axial direction of the registration roller unit.

FIGS. 4 and 5 are cross sectional views illustrating a registration roller unit 60 including the pair of registration rollers 18, in cross sections in a direction perpendicular to an axial direction of the pair of registration rollers 18. To be more specific, FIG. 4 is a cross sectional view illustrating the registration roller unit 60 in a locked state, disposed on the drawer unit 30. FIG. 5 is a cross sectional view illustrating the registration roller unit 60 in a non-lock state, disposed on the drawer unit 30. It is to be noted that FIGS. 4 and 5 are views of FIGS. 6 and 7, along a line A-A'.

The pair of registration rollers 18 according to the present embodiment includes a registration drive roller 18A and a registration driven roller 18B as an integral unit. The pair of registration rollers 18 is configured to convey the sheet P while gripping the sheet P. In addition to this function, the pair of registration rollers 18 is also configured to correct angular displacement of the sheet P (in other words, skew of the sheet P). Specifically, when the leading end of the sheet P reaches and contacts the pair of registration rollers 18 while the pair of registration rollers 18 is stopped, the sheet P is further conveyed by a given distance to form a slack, so that the angular displacement (i.e., the skew) of the sheet P is corrected. The pair of registration rollers 18 according to the present embodiment is implemented in the drawer unit 30 while being provided in the registration roller unit 60.

The registration roller unit 60 of the present embodiment includes the registration drive roller 18A and the registration driven roller 18B of the pair of registration rollers 18, a unit side panel 61A (see FIGS. 6 and 7), a unit side panel 61B, a unit opening and closing portion 62, a contact target projection 63A (see FIG. 8B), a contact target projection 63B, a lock claw 65A (see FIGS. 6 and 7), and a lock claw 65B. The unit opening and closing portion 62 that functions as a switching unit is openably and closably attached to the unit side panels 61A and 61B. The contact target projections 63A and 63B, each of which functions as a contact target body, are provided on the unit opening and closing portion 62. The lock claws 65A and 65B are mounted on a lock lever shaft 64.

The registration drive roller 18A has end portions in the axial direction that are rotatably supported by the unit side panels 61A and 61B, respectively. The registration drive roller 18A is driven and rotated by a registration motor that functions as a drive unit and a drive transmission mechanism, both provided in the housing 1 of the image forming apparatus 100. On the other hand, the registration driven roller 18B has end portions in the axial direction that are rotatably supported by the unit opening and closing portion 62. A gear attached to the registration drive roller 18A is meshed with a gear attached to the registration driven roller 18B. With this configuration, the registration driven roller 18B is rotated along with rotation of the registration drive roller 18A. Drive transmission to the registration driven roller 18B is not limited to this configuration. For example, the registration driven roller 18B may be rotated with frictional resistance in the nip region with the registration drive roller 18A.

The unit opening and closing portion 62 is rotatably supported by respective studs 61*a* mounted on the unit side panels 61A and 61B via respective hinges 62*a* fixed on the unit opening and closing portion 62. With this configuration, the state of the unit opening and closing portion 62 switches between a state in which the unit opening and closing portion 62 is closed and locked by a lock mechanism 400 as illustrated in FIG. 4 (in other words, a locked state) and a state in which the unit opening and closing portion 62 is unlocked as illustrated in FIG. 5 (in other words, a non-lock state). In the locked state in which the unit opening and closing portion 62 is closed, the registration driven roller 18B that is supported by the unit opening and closing portion 62 is pressed by the registration drive roller 18A that is supported by the unit side panels 61A and 61B. Therefore, the registration drive roller 18A and the registration driven roller 18B of the pair of registration rollers 18 contact with each other in a press contact state. On the other hand, in the non-lock state in which the unit opening and closing portion 62 is released from the locked state, the registration driven roller 18B is released from the press contact state with the registration drive roller 18A. Therefore, the registration drive roller 18A and the registration driven roller 18B of the pair of registration rollers 18 contact with each other in a non-press contact state, in other words, in a roller separated state.

Two contact target projections 63A and 63B are provided on an upper face of (a cover portion 62*c* of) the unit opening and closing portion 62, at different positions in the axial direction of the pair of registration rollers 18. As the contact target projections 63A and 63B are pressed downwardly, pressing forces of the contact target projections 63A and 63B are transmitted to the unit opening and closing portion 62. Consequently, the unit opening and closing portion 62 rotates about the studs 61*a* of the unit side panels 61A and 61B to come to the locked state in which the unit opening and closing portion 62 is closed. Instead of the above-described operation, as the upper face of the unit opening and closing portion 62 (in other words, the upper face of the covered portion 62*c*) is directly pressed down, the unit opening and closing portion 62 is closed to the locked state.

Figure 6:
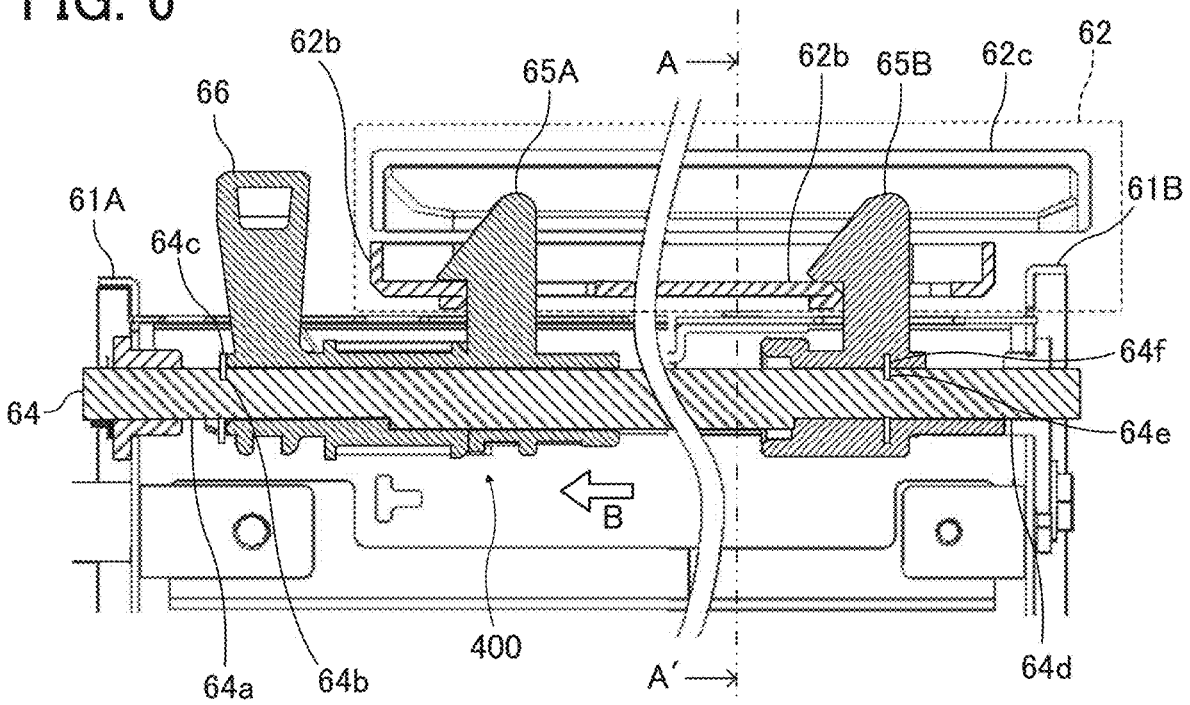
FIG. 6 is a cross sectional view illustrating a lock mechanism in a locked state, cut in a direction passing an axial center of a lock lever shaft.
Figure 7:
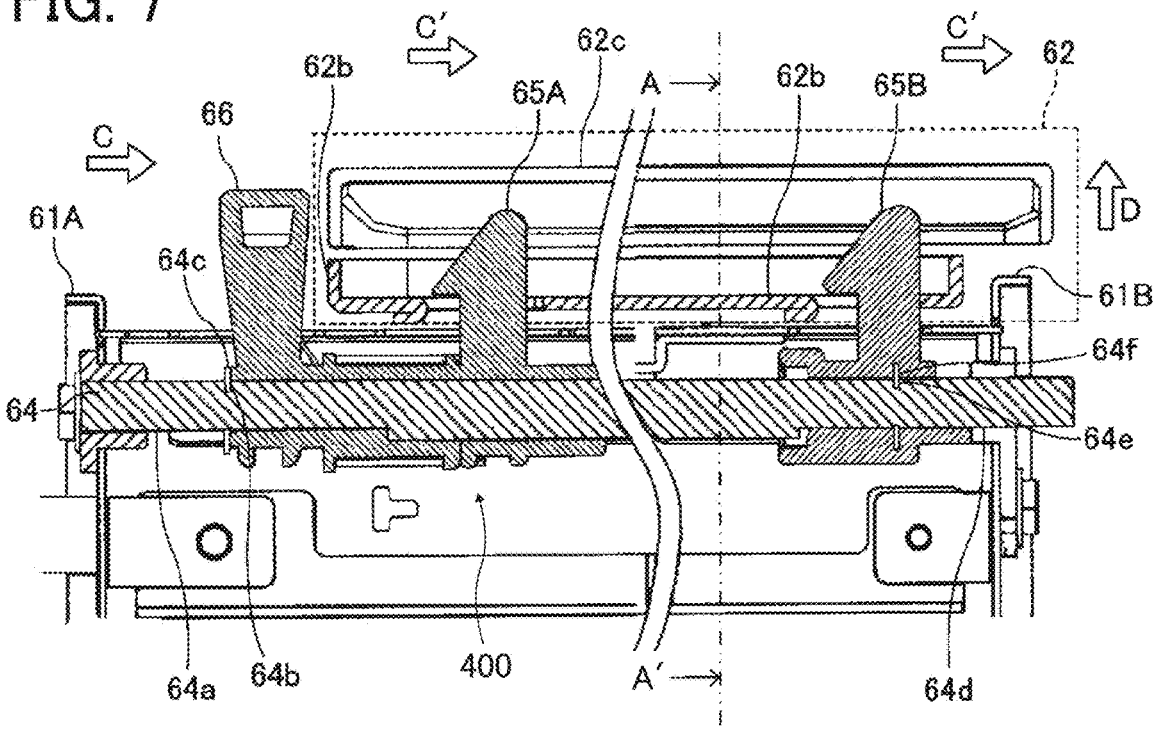
FIG. 7 is a cross sectional view illustrating the lock mechanism in a non-lock state, cut in the direction passing the axial center of the lock lever shaft.
Figure 8A:
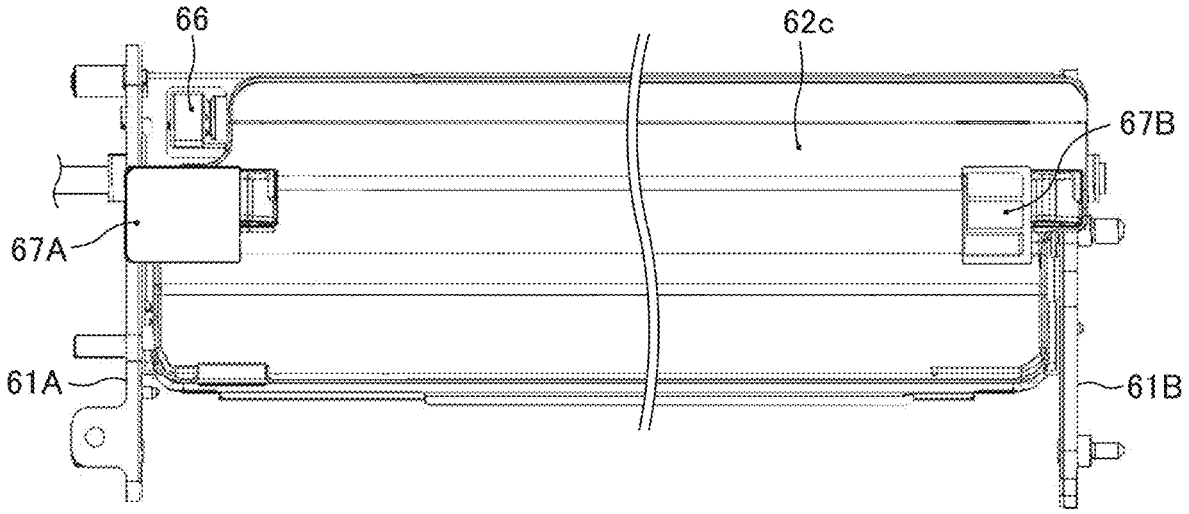
FIG. 8A is a top view illustrating the registration roller unit together with contact projections disposed on a side of the housing of the image forming apparatus.
Figure 8B:
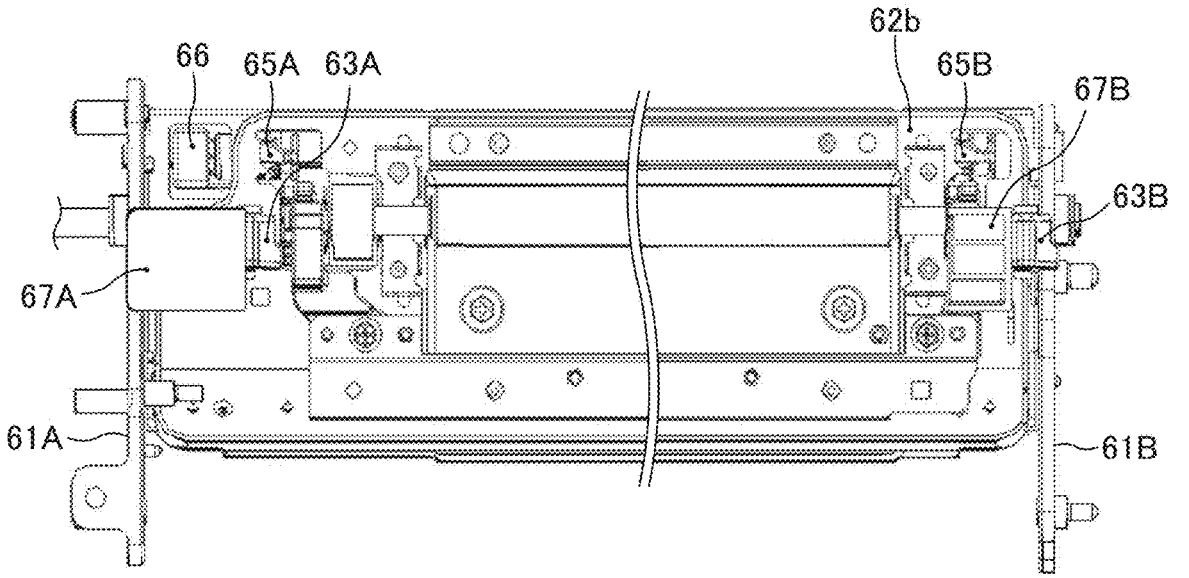
FIG. 8B is a top view illustrating the registration roller unit with a cover of a unit open and close portion of the registration roller unit removed.

FIG. 6 is a cross sectional view illustrating the lock mechanism 400 according to the present embodiment in a locked state, cut in a direction passing an axial center of the lock lever shaft 64. FIG. 7 is a cross sectional view illustrating the lock mechanism 400 according to the present embodiment in a non-lock state, cut in the direction passing the axial center of the lock lever shaft 64. FIG. 8A is a top view illustrating the registration roller unit 60 together with contact projections 67A and 67B, each functioning as a contact body, provided in the housing 1 of the image forming apparatus 100. FIG. 8B is a top view illustrating the registration roller unit 60 with the cover portion 62*c* of the unit opening and closing portion 62 being removed, in order to explain details of the lock mechanism 400.

The state of the lock mechanism 400 according to the present embodiment switches between the locked state in which the unit opening and closing portion 62 is locked while being closed (in other words, while the registration drive roller 18A and the registration driven roller 18B of the pair of registration rollers 18 contact in the press contact state) (see FIGS. 6, 8A, and 8B) and the non-lock state in which the unit opening and closing portion 62 is released from the locked state to cause the registration drive roller 18A and the registration driven roller 18B to be switched to the non-press contact state (see FIG. 7).

The lock mechanism 400 functions as a lock unit and includes the lock lever shaft 64, the lock claws 65A and 65B, and a lock lever 66. In the lock mechanism 400 according to the present embodiment, the lock lever 66 is fixed to the lock lever shaft 64. The lock lever 66 is exposed to the outside of the registration roller unit 60. Specifically, the lock lever 66 is fitted into a D-cut portion 64 a of the lock lever shaft 64, and therefore the lock lever 66 is not rotated about the axis of the lock lever shaft 64. Further, an E-ring 64*c* is fitted into a groove 64*b* that is formed in the lock lever shaft 64. An end portion of the lock lever 66 on the front side of the image forming apparatus 100 contacts the E-ring 64*c*, so that the lock lever 66 is restricted from moving toward the front side of the image forming apparatus 100 to the lock lever shaft 64 (in other words, movement of the lock lever 66 in a direction indicated by arrow B in FIG. 6 is restricted).

Further, the lock lever shaft 64 includes the lock claws 65A and 65B fixed on different positions in the axial direction of the pair of registration rollers 18. The lock claw 65A on the front side of the image forming apparatus 100 is formed as an integral unit with the lock lever 66 and is fixed on the lock lever shaft 64. The lock claw 65B on the rear side of the image forming apparatus 100 is fitted into a D-cut portion 64*d* of the lock lever shaft 64, and therefore the lock claw 65B is not rotated about the axis of the lock lever shaft 64. Further, an E-ring 64*f* is fitted into a groove 64*e* that is formed in the lock lever shaft 64. A groove in the lock claw 65B is fitted into the E-ring 64*f*. With this configuration, the lock claw 65B is restricted from moving toward the roller axial direction to the lock lever shaft 64.

In addition, the lock lever shaft 64 is supported to be movable in the roller axial direction to the unit side panels 61A and 61B. A biasing member such as a spring applies a biasing force to the lock lever shaft 64 in the direction B in FIG. 6. By moving the lock lever 66 in a direction indicated by arrow C in FIG. 7, the lock lever shaft 64 is moved in the direction C in FIG. 7 against the biasing force of the biasing member. Along with the movement of the lock lever shaft 64 in the direction C, the lock claws 65A and 65B are moved in a direction indicated by arrows C' in FIG. 7.

As illustrated in FIG. 6, in the state in which the unit opening and closing portion 62 is closed, a tip of each of the lock claws 65A and 65B comes (bites) into the unit opening and closing portion 62. The tip of each of the lock claws 65A and 65B has a claw shape. At this time, the lock lever shaft 64 is biased in the direction B in FIG. 6, and therefore the lock claws 65A and 65B are biased in a direction to contact a frame portion 62*b* of the unit opening and closing portion 62. With this configuration, the tip (having the claw shape) of each of the lock claws 65A and 65B are caught by the frame portion 62*b*, and rotation of the unit opening and closing portion 62 in an opening direction is restricted, so that the unit opening and closing portion 62 comes into the locked state.

In a case in which the unit opening and closing portion 62 is opened for the paper jam handling, a user moves the lock lever 66 in the direction C in FIG. 7. Along with this operation, the lock claws 65A and 65B move in the direction C in FIG. 7, so that the tip (having the claw shape) of each of the lock claws 65A and 65B is released from the frame portion 62*b* of the unit opening and closing portion 62. Accordingly, restriction of the unit opening and closing portion 62 in the opening direction is released, and the unit opening and closing portion 62 comes into the non-lock state.

In the non-lock state, the pair of registration rollers 18 in the press contact state is switched to the non-press contact state. Along with the change of the state of the pair of registration rollers 18, a center distance between the registration drive roller 18A and the registration driven roller 18B of the pair of registration rollers 18 in the non-press contact state become greater (wider) than the center distance of the pair of registration rollers 18 in the press contact state. As a result, the unit opening and closing portion 62 that supports the registration driven roller 18B is pushed up from the unit side panels 61A and 61B in a direction indicated by arrow D in FIG. 7. In this state, the frame portion 62*b* of the unit opening and closing portion 62 is located higher than the tip (having the claw shape) of each of the lock claws 65A and 65B. Consequently, the tip (having the claw shape) of each of the lock claws 65A and 65B is located outside of the unit opening and closing portion 62. Therefore, even though the user stops moving the lock lever 66 in the direction C in FIG. 7 and the lock lever shaft 64 and the lock claws 65A and 65B are moved in the direction B in FIG. 6 due to the biasing force, the tip (having the claw shape) of each of the lock claws 65A and 65B is not caught by the frame portion 62*b*. Accordingly, the non-lock state is maintained.

When closing the unit opening and closing portion 62, in a case in which the contact target projections 63A and 63B of the unit opening and closing portion 62 are pressed down or the upper face of the unit opening and closing portion 62 is directly pressed down, the frame portion 62*b* of the unit opening and closing portion 62 contacts the upper face of the tip (having the claw shape) of each of the lock claws 65A and 65B. The upper face of the tip (having the claw shape) of each of the lock claws 65A and 65B includes a sloped face as illustrated in FIGS. 6 and 7. Along with downward movement of the unit opening and closing portion 62, the frame portion 62*b* slides on the sloped face of the lock claws 65A and 65B. Consequently, the lock claws 65A and 65B move in the direction C' in FIG. 7 against the above-described biasing force of the biasing member. Thereafter, when the unit opening and closing portion 62 continues to move downwardly until the tip (having the claw shape) of each of the lock claws 65A and 65B bites into the inside of the unit opening and closing portion 62, the lock lever shaft 64 and the lock claws 65A and 65B move in the direction B in FIG. 6 due to the biasing force. Consequently, the tip (having the claw shape) of each of the lock claws 65A and 65B is caught by the frame portion 62*b*, so that the unit opening and closing portion 62 is restricted from rotating in the opening direction to come into the locked state.

Figure 9:
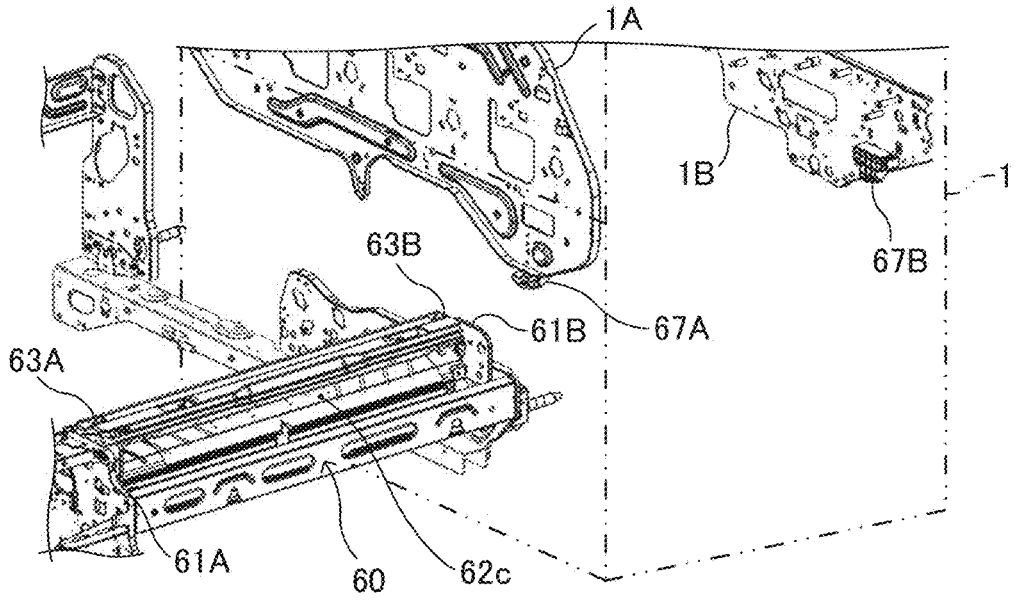
FIG. 9 is a perspective view illustrating a positional relation of contact target projections of the registration roller unit and the contact projections of the housing of the image forming apparatus when the drawer unit is located at a pull-out position.
Figure 10:
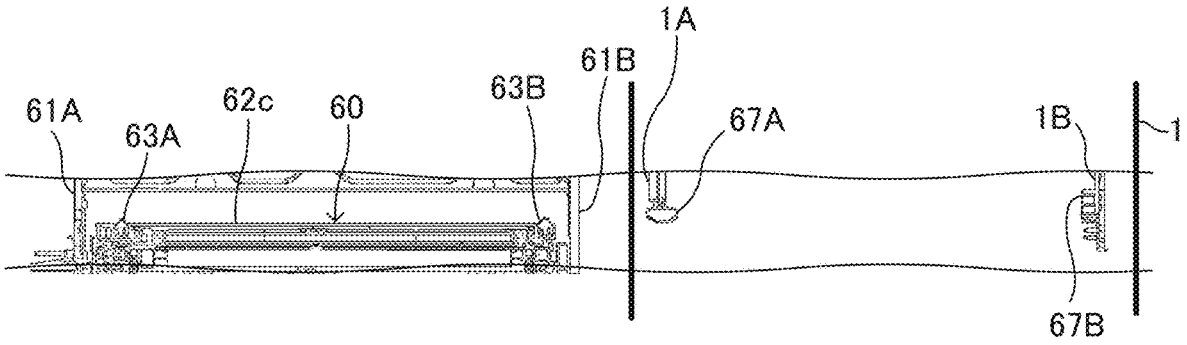
FIG. 10 is a side view illustrating the contact target projections of the registration roller unit and the contact projections of the housing of the image forming apparatus of FIG. 9.
Figure 11:
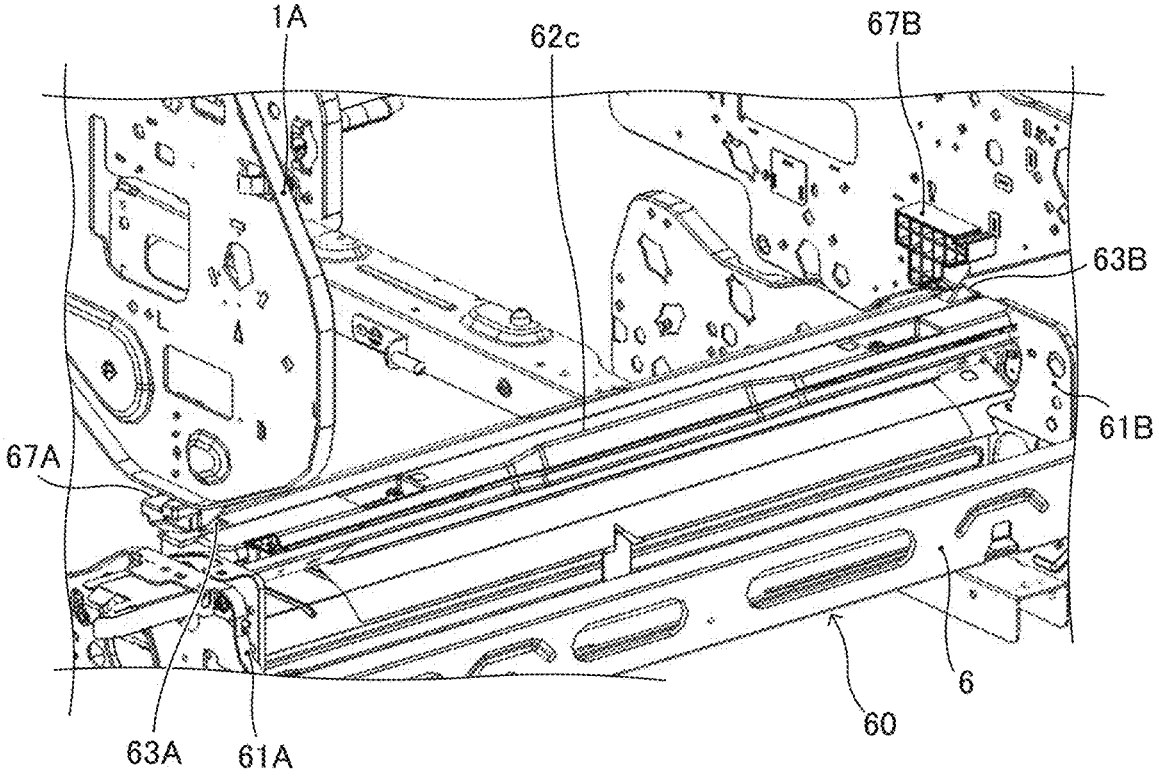
FIG. 11 is a perspective view illustrating a positional relation of the contact target projections of the registration roller unit and the contact projections of the housing of the image forming apparatus when the drawer unit is located at the drawer storage position.
Figure 12:
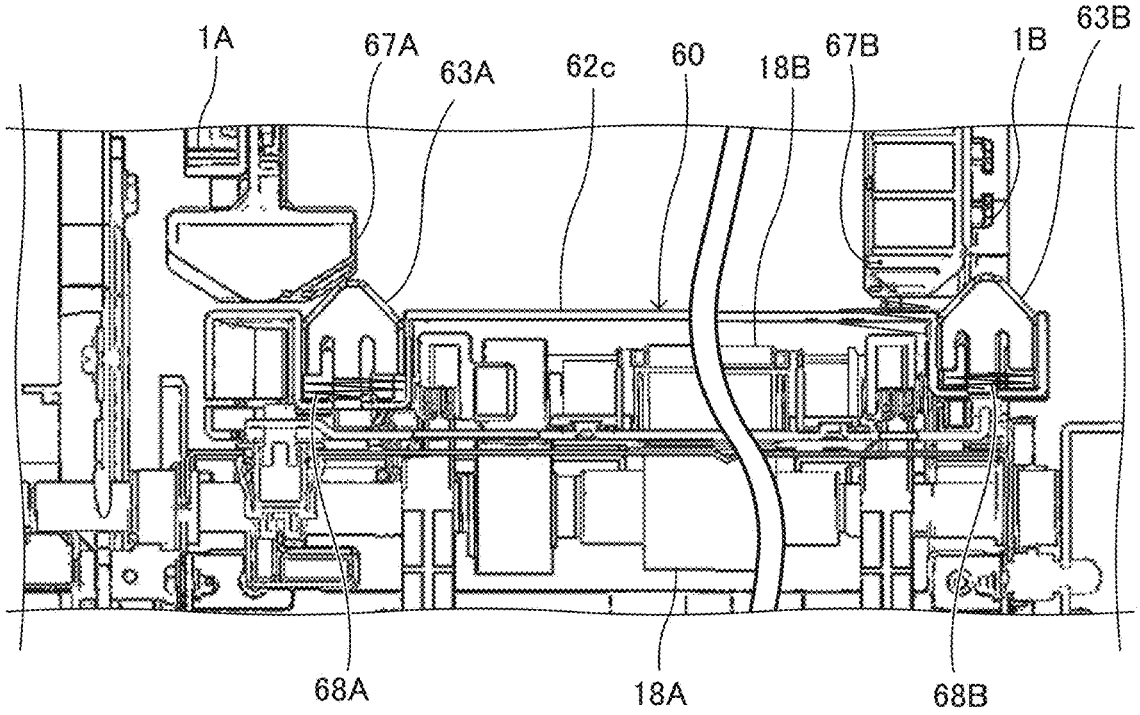
FIG. 12 is a side view (enlarged view) illustrating the contact target projection of the registration roller unit and the contact projection of the housing of the image forming apparatus of FIG. 11.
Figure 13A:
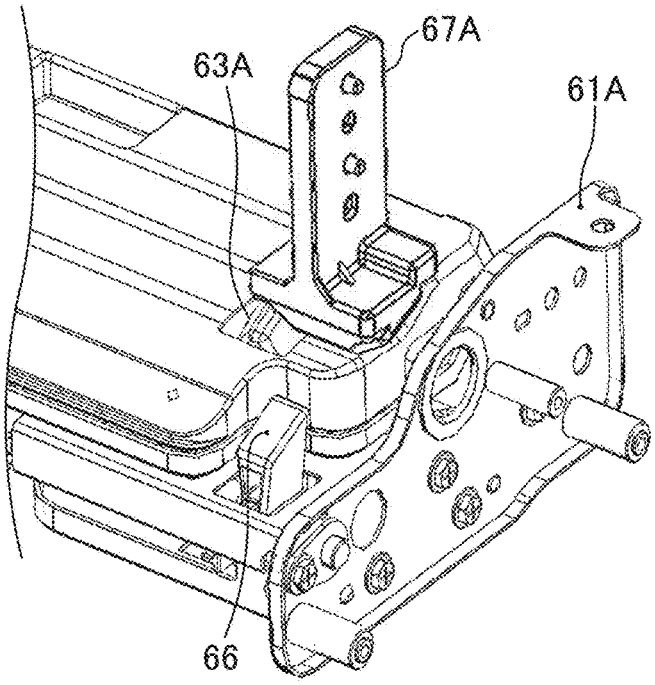
FIG. 13A is a perspective view illustrating the registration roller unit disposed on a front side of the image forming apparatus, together with the contact projection disposed on the front side of the housing of the image forming apparatus.
Figure 13B:
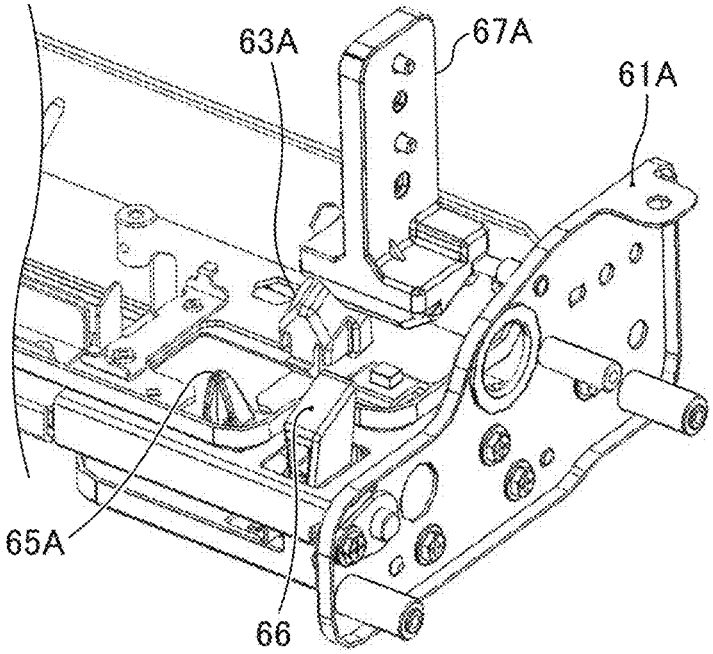
FIG. 13B is a perspective view illustrating the registration roller unit of FIG. 13A, with a cover of a unit open and close portion of the registration roller unit being removed.
Figure 14A:
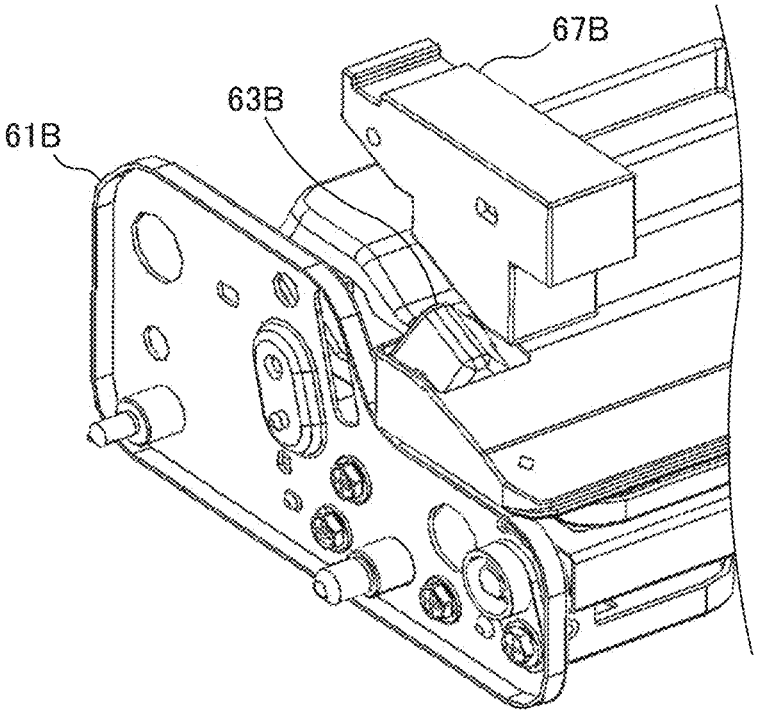
FIG. 14A is a perspective view illustrating the registration roller unit disposed on a rear face of the image forming apparatus, together with the contact projection disposed on the front side of the housing of the image forming apparatus.
Figure 14B:
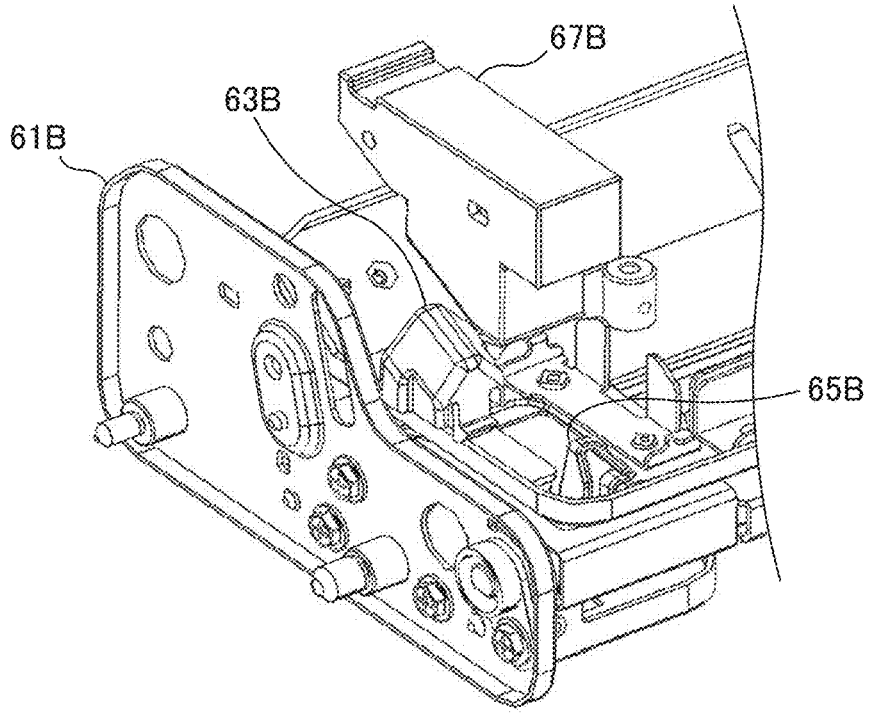
FIG. 14B is a perspective view illustrating the registration roller unit of FIG. 14A, with the cover of the unit open and close portion of the registration roller unit being removed.

FIG. 9 is a perspective view illustrating a positional relation of the contact target projections 63A and 63B of the registration roller unit 60, mounted on the unit opening and closing portion 62, and the contact projections 67A and 67B (each of which functions as a contact body) of the housing 1 of the image forming apparatus 100 when the drawer unit 30 is located at the pull-out position. FIG. 10 is a side view illustrating the contact target projections 63A and 63B of the registration roller unit 60 and the contact projections 67A and 67B of the housing 1 of the image forming apparatus 100 of FIG. 9. FIG. 11 is a perspective view illustrating a positional relation of the contact target projections 63A and 63B of the registration roller unit 60, mounted on the unit opening and closing portion 62, and the contact projections 67A and 67B of the housing 1 of the image forming apparatus 100 when the drawer unit 30 is located at the drawer storage position. FIG. 12 is a side view (enlarged view) illustrating the contact target projections 63A and 63B of the registration roller unit 60 and the contact projections 67A and 67B of the housing 1 of the image forming apparatus 100 of FIG. 11. FIG. 13A is a perspective view illustrating the registration roller unit 60 disposed a front face side of the image forming apparatus 100, together with the contact projection 67A disposed on the front side of the housing 1 of the image forming apparatus 100. FIG. 13B is a perspective view illustrating the registration roller unit 60 of FIG. 13A. FIG. 14A is a perspective view illustrating the registration roller unit 60 disposed on a rear face side of the image forming apparatus 100, together with the contact projection 67B disposed on the front side of the housing 1 of the image forming apparatus 100. FIG. 14B is a perspective view illustrating the registration roller unit 60 of FIG. 14A. It is to be noted that FIGS. 13B and 14B illustrate the registration roller unit 60 without the cover portion 62*c* of the unit opening and closing portion 62 (in other words, while the cover portion 62*c* of the unit opening and closing portion 62 is removed from the registration roller unit 60).

In the present embodiment, the two contact projections 67A and 67B are disposed in the housing 1 of the image forming apparatus 100, at different positions from each other in the axial direction. The contact projections 67A and 67B function as contact bodies to contact the contact target projections 63A and 63B of the registration roller unit 60 to push up (close) the unit opening and closing portion 62 during storing movement in which the drawer unit 30 moves toward the drawer storage position or at completion of the storing movement. Specifically, the contact projection 67A is disposed on the front side of the image forming apparatus 100 and functions as a first contact body disposed on the front side of the image forming apparatus 100. The contact projection 67B is disposed on the rear side of the image forming apparatus 100 and functions as a second contact body disposed on the rear side of the image forming apparatus 100. Hereinafter, the contact projection 67A is occasionally referred to as a front contact projection 67A and the contact projection 67B is occasionally referred to as a rear contact projection 67B. The front contact projection 67A is fixed to a panel 1A of the housing 1 of the image forming apparatus 100. The rear contact projection 67B is fixed to a side plate 1*b* of the intermediate transfer unit disposed in the housing 1 of the image forming apparatus 100.

When the drawer unit 30 is disposed at the pull-out position, the front contact projection 67A that functions as a first contact body on the front side of the image forming apparatus 100 is disposed at a position closer to the drawer storage position (i.e., a position closer to the rear side of the image forming apparatus 100) than positions of the contact target projections 63A and 63B of the registration roller unit 60 are, as illustrated in FIGS. 9 and 10. When the drawer unit 30 is disposed at the drawer storage position, the front contact projection 67A is disposed at a position closer to the pull-out position (i.e., a position closer to the front side of the image forming apparatus 100) than positions of the contact target projections 63A and 63B of the registration roller unit 60 are, as illustrated in FIGS. 11 and 12.

According to this configuration, even if the drawer unit 30 is pushed from the pull-out position to the drawer storage position while the unit opening and closing portion 62 of the registration roller unit 60 is in the non-lock state, both of the contact target projections 63A and 63B of the registration roller unit 60 on the drawer unit 30 sequentially contact the front contact projection 67A on the front side of the housing 1 of the image forming apparatus 100 during the storing movement of the drawer unit 30 or at completion of the storing movement. Then, at the time of contact, the front contact projection 67A on the front side of the housing 1 of the image forming apparatus 100 presses down the contact target projections 63A and 63B. In response to this pressing, the unit opening and closing portion 62 is pressed down and closed to enter the locked state.

Figure 15:
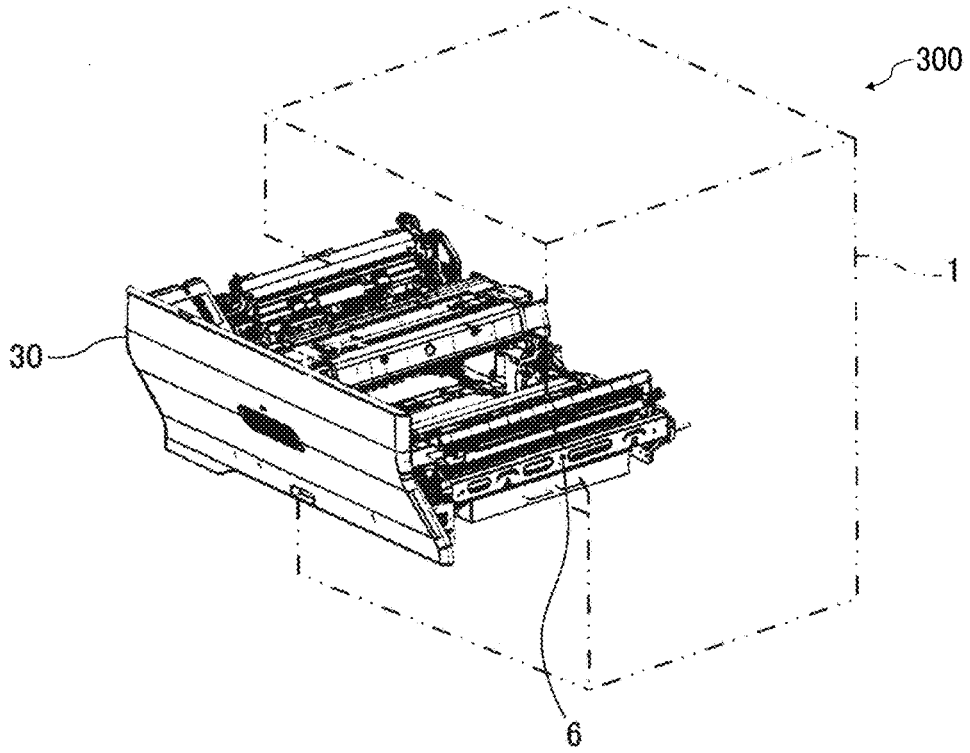
FIG. 15 is a perspective view illustrating a state in which the drawer unit is pulled out to a halfway position.
Figure 16:
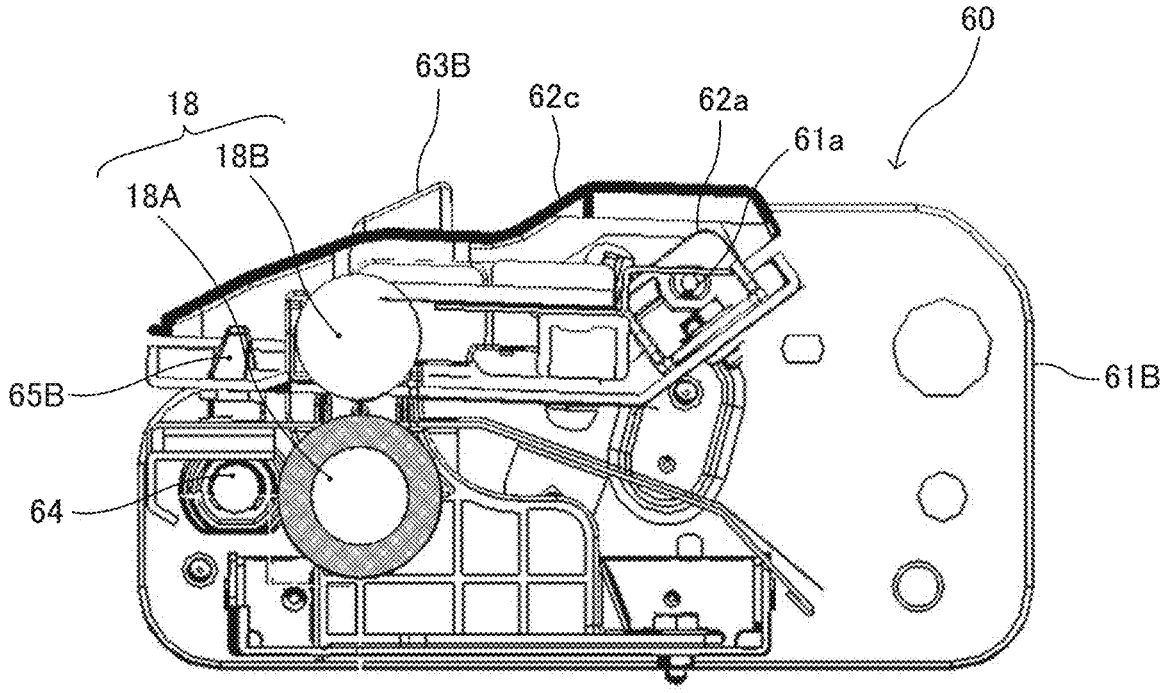
FIG. 16 is a cross sectional view illustrating the registration roller unit disposed on the drawer unit that is pulled out to the halfway position, in a state in which the locking of the registration roller unit is unlocked, cut in the direction perpendicular to the axial direction of the pair of registration rollers.

FIG. 15 is a perspective view illustrating a state in which the drawer unit 30 is pulled out to a halfway position that is an intermediate position between the drawer storage position illustrated in FIG. 2 and the pull-out position illustrated in FIG. 3, toward the pull-out position. FIG. 16 is a cross sectional view illustrating the registration roller unit 60 disposed on the drawer unit 30 that is pulled out to the halfway position, in a state in which the locked state of the registration roller unit 60 is unlocked, cut in the direction perpendicular to the axial direction of the pair of registration rollers 18. It is to be noted that FIG. 16 has the same cross section as FIGS. 4 and 5.

In the present embodiment, even when the drawer unit 30 is not pulled out to the pull-out position illustrated in FIG. 3, if the drawer unit 30 is pulled out to a position at which the unit opening and closing portion 62 of the registration roller unit 60 is unlocked (i.e., the halfway position), the locking of the unit opening and closing portion 62 is released (unlocked) to enter the non-lock state illustrated in FIG. 16. In the case of the present embodiment, when the lock lever 66 on the registration roller unit 60 is pulled out to a position at which a user can handle the lock lever 66, the user uses the lock lever 66 to release (unlock) the locking of the unit opening and closing portion 62 so that the state of the drawer unit 30 enters the non-lock state.

Here, even if the unit opening and closing portion 62 enters the non-lock state at the halfway position, the unit opening and closing portion 62 contacts the intermediate transfer unit of the housing 1 in a middle of an opening operation of the unit opening and closing portion 62. The contact of the unit opening and closing portion 62 to the intermediate transfer unit stops further opening of the unit opening and closing portion 62. Therefore, an aperture angle of the unit opening and closing portion 62 that can open at the halfway position illustrated in FIG. 15 is smaller than an aperture angle of the unit opening and closing portion 62 that can open at the pull-out position illustrated in FIG. 3.

Even at the halfway position, the unit opening and closing portion 62 is in the non-lock state, the pressing of the registration driven roller 18B to the registration drive roller 18A is released, and the pair of registration rollers 18 is in a non-press contact state. Therefore, the sheet P that is sandwiched by the pair of registration rollers 18 is removed easily, and therefore paper jam handling is performed easily. For this reason, some users operate the lock lever 66 to the non-lock state and perform the paper jam handling, while pulling out the drawer unit 30 not to the pull-out position but to the halfway position.

Figure 17:
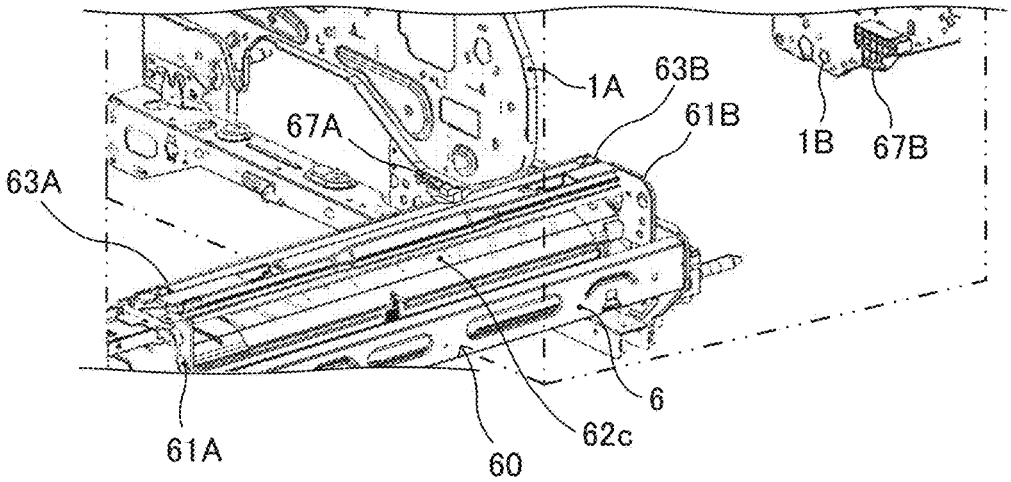
FIG. 17 is a perspective view illustrating the positional relation of a contact target projection of the registration roller unit and the contact projection of the housing of the image forming apparatus when the drawer unit is located at the halfway position.
Figure 18:
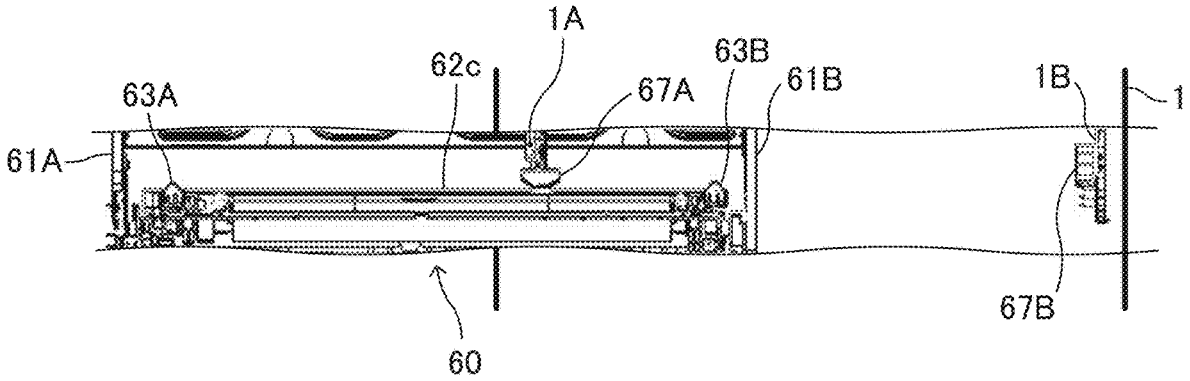
FIG. 18 is a side view illustrating the contact target projection of the registration roller unit and the contact projection of the housing of the image forming apparatus of FIG. 17.

FIG. 17 is a perspective view illustrating the positional relation of the contact target projections 63A and 63B mounted on the unit opening and closing portion 62 of the registration roller unit 60 and the front contact projection 67A and the rear contact projection 67B functioning contact bodies mounted on the housing 1 of the image forming apparatus 100 when the drawer unit 30 is located at the halfway position. FIG. 18 is a side view illustrating the positional relation of the contact target projections 63A and 63B and the front contact projection 67A and the rear contact projection 67B of FIG. 17.

In a case in which the paper jam handling is performed at the halfway position of the drawer unit 30, when the drawer unit 30 is pushed to the drawer storage position of the drawer unit 30, the drawer unit 30 moves from the halfway position to the drawer storage position. At this time, of the two contact target projections 63A and 63B mounted on the unit opening and closing portion 62 of registration roller unit 60 on the drawer unit 30, the contact target projection 63B disposed on the rear side of the image forming apparatus 100 is located closer to the drawer storage position (i.e., a position closer to the rear side of the image forming apparatus 100) than the front contact projection 67A on the front side of the image forming apparatus 100 is, as illustrated in FIGS. 17 and 18. Hereinafter, the rear contact target projection 63B disposed on the rear side of the image forming apparatus 100 is occasionally referred to as a rear contact target projection 63B. Therefore, in a case in which the drawer unit 30 is pushed from the halfway position to the drawer storage position while the unit opening and closing portion 62 of the registration roller unit 60 is in the non-lock state, the rear contact target projection 63B on the rear side of the image forming apparatus 100 does not contact the front contact projection 67A on the front side of the housing 1 or is not pressed down by the front contact projection 67A on the front side of the housing 1.

Consequently, in a case in which a single projection mounted on the housing 1 of the image forming apparatus 100 is the front contact projection 67A on the front side of the housing 1 of the image forming apparatus 100 alone, the drawer unit 30 reaches the drawer storage position when the rear contact target projection 63B on the rear side of the housing 1 has not been pressed down (or has bee left being pressed down) by the front contact projection 67A on the front side of the housing 1 of the image forming apparatus 100.

Figure 19:
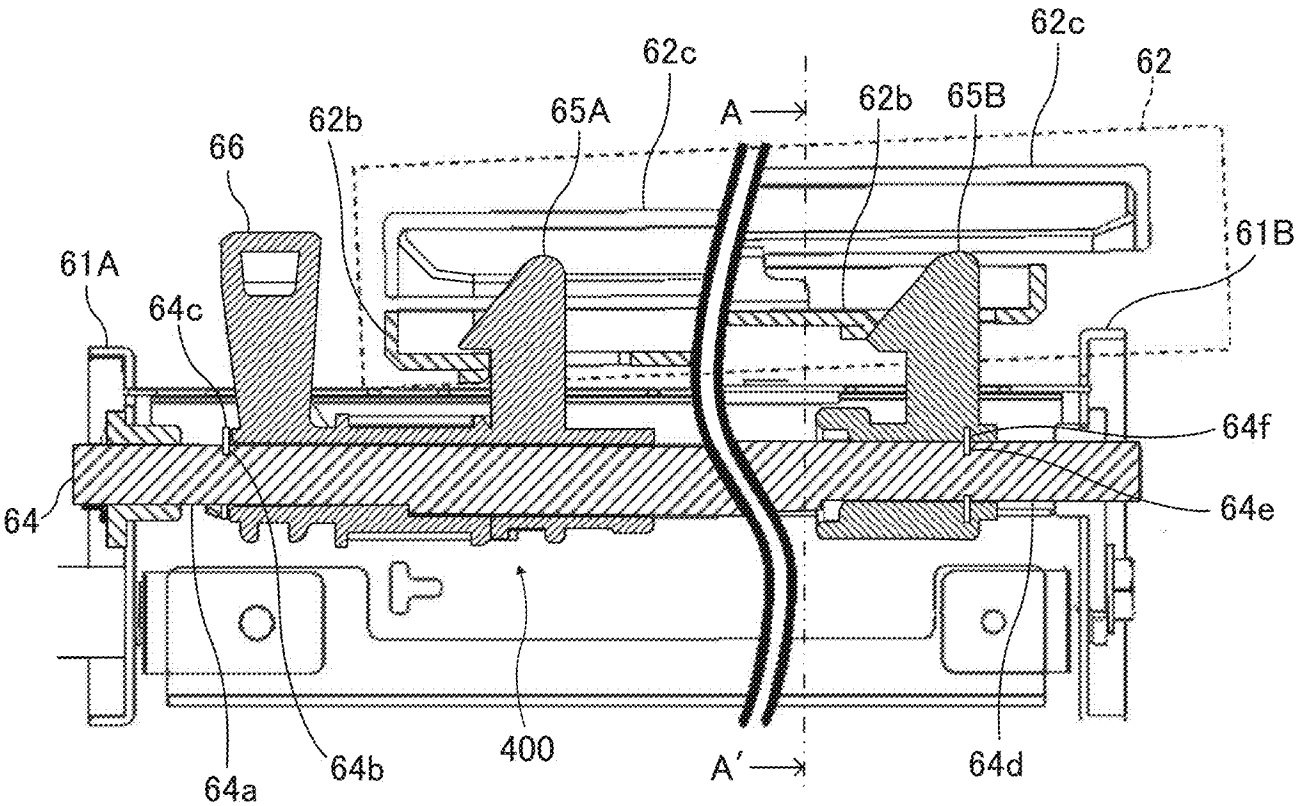
FIG. 19 is a cross sectional view illustrating a state in which a front side lock claw alone is hooked to a frame of the unit open and close portion.

FIG. 19 is a cross sectional view illustrating a state in which the lock claw 65A on the front side of the image forming apparatus 100 alone is hooked to the frame portion 62*b* of the unit opening and closing portion 62. As illustrated in FIG. 19, the contact target projection 63A is pressed down by the front contact projection 67A on the front side of the image forming apparatus 100, and therefore the lock claw 65A on the front side of the image forming apparatus 100 is caught by the frame portion 62*b* of the unit opening and closing portion 62. By contrast, the rear contact target projection 63B is not pressed down by the front contact projection 67A on the front side of the image forming apparatus 100, the lock claw 65B on the rear side of the image forming apparatus 100 is not caught by the frame portion 62*b* of the unit opening and closing portion 62. Hereinafter, the contact target projection 63A on the front side of the image forming apparatus 100 is occasionally referred to as a front contact target projection 63A. Similarly, the lock claw 65A on the front side of the image forming apparatus 100 is occasionally referred to as a front lock claw 65A and the lock claw 65B on the rear side of the image forming apparatus 100 is occasionally referred to as a rear lock claw 65B.

As a result, in a case in which the front contact projection 67A on the front side of the image forming apparatus 100 is a single contact projection on the housing 1 of the image front side of the image forming apparatus 100, when the drawer unit 30 is returned from the halfway position to the drawer storage position while the registration roller unit 60 is in the non-lock state, the front side of the pair of registration rollers 18 is pressed but the rear side of the pair of registration rollers 18 is not pressed. Therefore, in the pair of registration rollers 18, a contact pressure of the registration drive roller 18A and a contact pressure of the registration driven roller 18B are not even in the roller axial direction, resulting in a failure in which an original function of the pair of registration rollers 18 (e.g., skew correction and sheet conveyance) is not affected appropriately.

Therefore, in the present embodiment, the rear contact projection 67B that functions as a second contact body is provided in addition to the front contact projection 67A that functions as a first contact body. Both the front contact projection 67A and the rear contact projection 67B contact the rear contact target projection 63B of the registration roller unit 60 to press down the unit opening and closing portion 62. When the drawer unit 30 is located at the halfway position (in other words, the intermediate position), rear contact projection 67B is located closer to the drawer storage position (i.e., the rear side of the image forming apparatus 100) than rear contact target projection 63B (in other words, part of a contact target body located closer to the drawer storage position (i.e., the rear side of the image forming apparatus 100) than the front contact projection 67A). Further, when the drawer unit 30 is located at the drawer storage position, the rear contact projection 67B is located closer to the pull-out position (i.e., the front side of the image forming apparatus 100) than the rear contact target projection 63B, as illustrated in FIGS. 11 and 12.

According to the above-described configuration, even when the drawer unit 30 is returned from the halfway position to the drawer storage position while the registration roller unit 60 is in the non-lock state, the rear contact target projection 63B contacts the rear contact projection 67B of the housing 1 during the storing movement of the drawer unit 30 or at completion of the storing movement.

Figure 20:
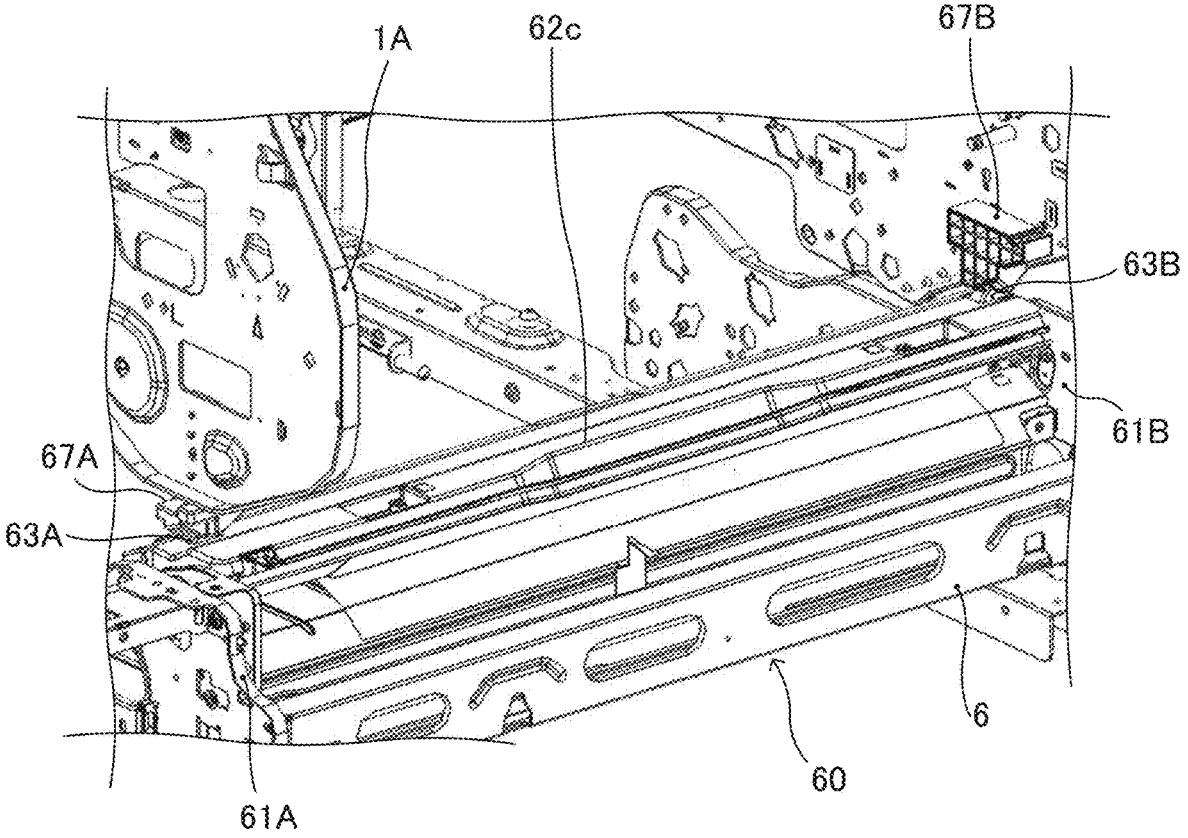
FIG. 20 is a perspective view illustrating a state in which the contact target projection of the registration roller unit is pulled down by the contact projection of the housing of the image forming apparatus while moving to the storing position.
Figure 21:
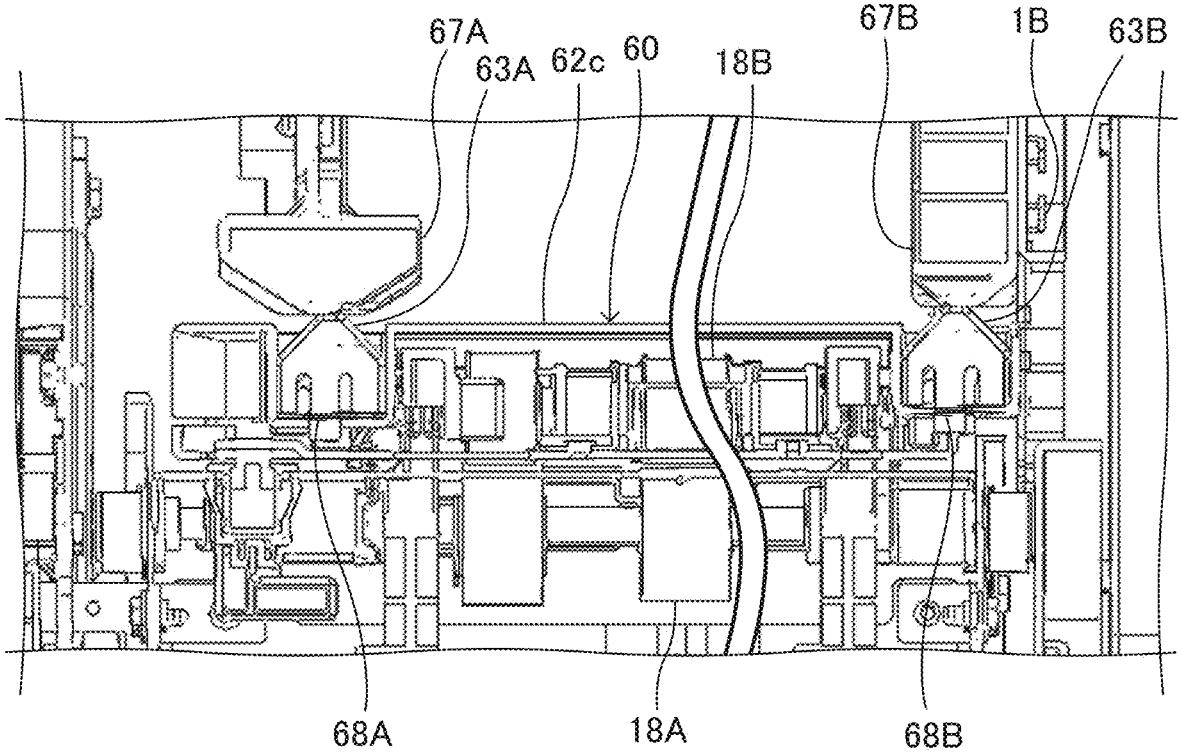
FIG. 21 is a side view illustrating the contact target projection of the registration roller unit and the contact projection of the housing of the image forming apparatus of FIG. 20.

FIG. 20 is a perspective view illustrating a state in which the rear contact target projection 63B of the registration roller unit 60 is pulled down by the rear contact projection 67B of the housing 1 of the image forming apparatus 100 while moving to the drawer storage position. FIG. 21 is a side view illustrating the rear contact target projection 63B of the registration roller unit 60 and the rear contact projection 67B of the housing 1 of the image forming apparatus 100 of FIG. 20.

When the rear contact target projection 63B contacts the rear contact projection 67B, the rear contact target projection 63B is pressed down by the rear contact projection 67B. As a result, before the drawer unit 30 returns to the drawer storage position, the front contact projection 67A and the rear contact projection 67B are pressed down. Therefore, the front lock claw 65A and the rear lock claw 65B are caught by the frame portion 62*b* of the unit opening and closing portion 62 to enter the locked state.

In the present embodiment, the front contact target projection 63A and the rear contact target projection 63B of the registration roller unit 60 are biased upwardly by springs 68A and 68B, as illustrated in FIG. 12. Therefore, impact that is generated by the contact of the rear contact projection 67B of the housing 1 is absorbed by the springs 68A and 68B. Therefore, the front contact target projection 63A, the rear contact target projection 63B, and the rear contact projection 67B are prevented from being damaged or broken due to the impact.

It is to be noted that the sheet conveying device 300 according to the present embodiment includes the drawer unit 30 in which pairs of rollers including at least the pair of registration rollers 18 hold and convey the sheet P and the housing 1 that functions as an apparatus body to which the drawer unit 30 is detachably attached. However, any configuration may be used as long as a pair of rollers holds and conveys a sheet. Therefore, any pair of rollers may be applied to this disclosure.

The configurations according to the above-descried embodiments are not limited thereto. This disclosure can achieve the following aspects effectively.

Aspect 1.

In Aspect 1, a sheet conveying device (for example, the sheet conveying device 300) includes a support (for example, the registration roller unit 60) configured to move between a storage position and a full open position, with respect to a housing (for example, the housing 1) of an image forming apparatus (for example, the image forming apparatus 100). The support includes a pair of rollers (for example, the pair of registration rollers 18), a plurality of contact bodies (for example, the front contact projection 67A and the rear contact projection 67B), and a switching unit (for example, the unit opening and closing portion 62). The pair of rollers includes two rollers (for example, the registration drive roller 18A, the registration driven roller 18B) and is configured to hold and convey a sheet (the sheet P). The plurality of contact bodies is provided in the housing of the image forming apparatus. The switching unit includes a plurality of contact target bodies (for example, the front contact target projection 63A and the rear contact target projection 63B) disposed at different positions along a direction of movement of the support and is configured to contact the plurality of contact bodies during the movement of the support or after completion of the movement of the support from the full open position to the storage position. The switching unit is configured to switch the two rollers between a press contact state and a roller separated state. The switching unit is configured to switch the two rollers from the roller separated state to the press contact state in response to contact of the plurality of contact target bodies with the plurality of contact bodies. The plurality of contact bodies includes a first contact body (for example, the front contact projection 67A) and a second contact body (for example, the rear contact projection 67B). The first contact body is located at a position closer to the storage position than the plurality of contact target bodies in a case in which the support is located at the full open position and is located at a position closer to the full open position than the plurality of contact target bodies is in a case in which the support is located at the storage position. The second contact body is located at a position closer to the storage position than part of the plurality of contact target bodies located closer to the storage position than the first contact body in a case in which the support is located at a halfway position between the storage position and the full open position and is located at a position closer to the full open position than the plurality of contact target bodies in a case in which the support is located at the storage position.

In Aspect 1, the two rollers of the pair of rollers is switched from the roller separated state to the press contact state, along with storing movement in which the support having the pair of rollers is moved from the full open position to the storage position to the housing. To be more specific, during the storing movement of the support toward the storage position or at completion of the storing movement of the support, the plurality of contact target bodies, which is disposed at different positions from each other in the direction of the storing movement of the support, contacts the plurality of contact bodies provided in the housing of the image forming apparatus. By so doing, the state of the two rollers of the pair of rollers switches from the roller separated state to the press contact state. In a configuration of a comparative sheet conveying device in which a drive unit is driven to switch a pair of rollers from the roller separated state to the press contact state, in a case in which the drive unit is damaged or broken or a controller of the drive unit is damaged or broken, even when a support of the comparative sheet conveying device is moved to the storage position, the pair of rollers is not switched to the press contact state, which results in a sheet conveyance failure. By contrast, in the sheet conveyance device according to Aspect 1, the state of the pair of rollers is switched along with the storing movement of the support, without employing a drive unit to switch the state of the pair of rollers. Therefore, the inconvenience that the pair of rollers is not switched to the press contact state due to the failure that has been caused in the comparative configuration does not occur, and therefore occurrence of the sheet conveyance failure is reduced.

Further, even with the configuration in which the state of the two rollers is switched along with the storing movement of the support, when the support is once moved from the storage position to the halfway position between the storage position and the full open position and then is returned to the storage position, the pair of rollers in the roller separated state does not move to the press contact state.

To be more specific, the contact target bodies of the plurality of contact target bodies provided in the switching unit on the support are disposed at different positions from each other in the direction of the storing movement of the support. When the support is located at the full open position, the plurality of contact bodies of the housing of the image forming apparatus is located closer to the storage position than the plurality of contact target bodies while the plurality of contact bodies contacts the plurality of contact target bodies. In addition, when the support is located at the storage position, the plurality of contact bodies is located closer to the full open position than the plurality of contact target bodies. According to this configuration, even with a single contact body (for example, the first contact body alone), while the support at the full open position is moved to the storage position, the whole contact target bodies of the plurality of contact target bodies sequentially contact the single contact body. As a result, the state of the two rollers of the pair of rollers enters the press contact state.

However, in a case in which the support is moved up to the above-described halfway position with such a single contact body (i.e., the first contact body), part of the plurality of contact target bodies are located closer to the storage position than the single contact body. In this case, when the support is moved from the halfway position to the storage position, the rest of the plurality of contact target bodies other than the part of the plurality of contact target bodies contact the single contact body but the part of the plurality of contact target bodies do not contact the single contact body. Therefore, the state of the two rollers of the pair of rollers is not switched to the press contact state.

In order to address this inconvenience, in Aspect 1, even in a case in which the support at the storage position is moved up to the halfway position and then is returned to the storage position, the second contact body in addition to the first contact body is provided so that the state of the two rollers of the pair of rollers is switched to the press contact state. With the second contact body, in a case in which the support is moved from the halfway position (to be returned) to the storage position, the part of the plurality of contact target bodies that do not contact the first contact body contact the second contact body. As a result, even in a case in which the support is moved from the halfway position to the storage position, the whole contact target bodies of the plurality of contact target bodies contact at least a contact body (in this case, the first contact body and the second contact body), and therefore the state of the two rollers of the pair of rollers is switched to the press contact state.

Accordingly, not only in a case in which the support at the storage position is moved to the full open position but also a case in which the support is moved up to the halfway position, when the support is returned to the storage position, the state of the two rollers of the pair of rollers is switched to the press contact state, which restrains occurrence of sheet conveyance failure.

Aspect 2.

According to Aspect 1, the sheet conveying device (for example, the sheet conveying device 300) of Aspect 2 further includes a lock unit (for example, the lock mechanism 400) configured to switch a locked state in which the two rollers (for example, the registration drive roller 18A, the registration driven roller 18B) are in the press contact state and a non-lock state in which the two rollers enter from the locked state to the roller separated state. The lock unit is configured to switch the two rollers to the non-lock state in a case in which the support (for example, the registration roller unit 60) is located at the full open position and in a case in which the support is at the halfway position between the storage position and the full open position.

In Aspect 2, even in a case in which the support is moved to the position between the storage position and the full open position (in other words, the halfway position), the support enters the non-lock state to switch the two rollers of the pair of rollers (for example, the pair of registration rollers 18) to the roller separated state. In this case, the support is easily moved from the halfway position to the storage position, which is highly likely to cause the above-described inconvenience in which the two rollers of the pair of rollers in the roller separated state is not switched to the press contact state. According to this configuration of Aspect 2, even in a case in which such an inconvenience is likely to occur, the whole contact target bodies of the plurality of contact target bodies (for example, the front contact target projection 63A and the rear contact target projection 63B) contact the plurality of contact bodies (for example, the front contact projection 67A and the rear contact projection 67B) even when the support is moved from the halfway position to the storage position, as described above. Consequently, the two rollers of the pair of rollers enter the press contact state, thereby restraining occurrence of the above-described inconvenience.

Aspect 3.

According to Aspect 1 or Aspect 2, the pair of rollers of Aspect 3 is a pair of registration rollers (for example, the pair of registration rollers 18).

According to this configuration, not only a case in which the support at the storage position is moved (drawn) to the full open position but also a case in which the support is moved (drawn) to the halfway position, when the support (for example, the registration roller unit 60) is returned to the storage position, the pair of registration rollers is switched to the press contact state to deteriorate the function of the pair of registration rollers.

Aspect 4.

In Aspect 4, an image forming apparatus (for example, the image forming apparatus 100) includes the sheet conveying device (for example, the sheet conveying device 300) according to any one of Aspects 1 to 3, and an image forming unit (for example, the image forming units 2Y, 2M, 2C, and 2K) configured to form an image on the sheet (for example, the sheet P) conveyed by the sheet conveying device.

According to this configuration, not only a case in which the support (for example, the registration roller unit 60) at the storage position is moved (drawn) to the full open position but also a case in which the support is moved (drawn) to the halfway position, an image forming apparatus that performs reliable image formation is provided without causing any sheet conveyance failure.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

What is claimed is:

1. A sheet conveying device comprising:

a support configured to move between a storage position and a full open position, with respect to a housing of an image forming apparatus, the housing having a plurality of contact bodies including a first contact body and a second contact body, the support including, a pair of rollers including two rollers and configured to hold and convey a sheet; and a switching assembly including a plurality of contact target bodies disposed at different positions along a direction of movement of the support and configured to contact the plurality of contact bodies during the movement of the support or at completion of the movement of the support from the full open position to the storage position such that the plurality of contact bodies are configured to press downward on the plurality of contact target bodies to cause the two rollers to switch from a non-press contact state to a press contact state in response to contact of the plurality of contact target bodies with the plurality of contact bodies, wherein the first contact body is relatively closer to the storage position than the plurality of contact target bodies in a case in which the support is located at the full open position and is relatively closer to the full open position than the plurality of contact target bodies in a case in which the support is located at the storage position; and the second contact body is relatively closer to the storage position than one of the plurality of contact target bodies located closer to the storage position than the first contact body in a case in which the support is located at a halfway position between the storage position and the full open position and is relatively closer to the full open position than the one of the plurality of contact target bodies in a case in which the support is located at the storage position such that the second contact body presses downward on the one of the plurality of contact target bodies when the support moves from the halfway position to the storage position.

2. The sheet conveying device according to claim 1, further comprising:

a lock mechanism configured to switch between a locked state in which the two rollers are in the press contact state and a non-lock state in which the two rollers enter from the locked state to the non-press contact state, wherein the lock mechanism is configured to switch to the non-lock state in a case in which the support is located at the full open position and in a case in which the support is at the halfway position between the storage position and the full open position.

3. The sheet conveying device according to claim 1, wherein the pair of rollers is a pair of registration rollers.

4. An image forming apparatus comprising:

the sheet conveying device according to claim 1; and an image forming device within the housing, the image forming device configured to form an image on the sheet conveyed by the sheet conveying device.

5. The sheet conveying device according to claim 1, wherein the plurality of contact target bodies includes a first contact target body and a second contact target body, the first contact target body and the second contact target body each are projections projecting from the switching assembly in a first direction, and the first contact body and the second contact body are each projections projecting from the housing in a second direction opposite the first direction.

6. The sheet conveying device according to claim 5, wherein the second contact target body is configured to sequentially contact the first contact body and the second contact body as the support moves from the fully open position to the storage position.

7. The sheet conveying device according to claim 6, wherein the second contact target body is configured to contact the second contact body when the support moves from both of the full open position or the halfway position to the storage position.

* * * * *